US006733339B2

(12) United States Patent
Casey

(10) Patent No.: US 6,733,339 B2
(45) Date of Patent: May 11, 2004

(54) SHIELDED CONNECTOR WITH INTEGRAL LATCHING AND GROUND STRUCTURE

(75) Inventor: Daniel T. Casey, Harrisburg, PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 10/375,606

(22) Filed: Feb. 27, 2003

(65) Prior Publication Data

US 2003/0129879 A1 Jul. 10, 2003

Related U.S. Application Data

(62) Division of application No. 09/211,292, filed on Dec. 14, 1998, now Pat. No. 6,554,646.

(51) Int. Cl.[7] ..... H01R 13/648
(52) U.S. Cl. ..... 439/607
(58) Field of Search ..... 439/607, 939, 439/610, 540.1, 701, 717

(56) References Cited

U.S. PATENT DOCUMENTS

| | | | | | |
|---|---|---|---|---|---|
| 420,329 | A | * | 2/1890 | Lin et al. | D13/147 |
| 2,783,443 | A | * | 9/1957 | Jencks | 439/541.5 |
| 3,110,093 | A | * | 11/1963 | Johnson | 439/437 |
| 3,671,922 | A | * | 6/1972 | Erich et al. | 439/437 |
| 4,241,974 | A | * | 12/1980 | Hardesty | 439/437 |
| 4,337,989 | A | * | 7/1982 | Asick et al. | 439/437 |
| 4,345,122 | A | * | 8/1982 | Janniello | 439/437 |
| 4,582,378 | A | * | 4/1986 | Fruchard | 439/437 |
| 4,647,726 | A | * | 3/1987 | Blum | 439/437 |
| 4,838,808 | A | * | 6/1989 | Fujiura | 439/437 |
| 4,872,736 | A | * | 10/1989 | Myers et al. | 439/437 |
| 5,011,424 | A | * | 4/1991 | Simmons | 439/437 |
| 5,021,002 | A | * | 6/1991 | Noschese | 439/437 |
| 5,037,330 | A | * | 8/1991 | Fulponi et al. | 439/437 |
| 5,073,127 | A | * | 12/1991 | Daley et al. | 439/437 |
| 5,125,854 | A | * | 6/1992 | Bassler et al. | 439/607 |
| 5,176,541 | A | * | 1/1993 | Mori | 439/352 |
| 5,207,593 | A | * | 5/1993 | Bogiel | 439/352 |
| 5,328,390 | A | * | 7/1994 | Johnston et al. | 439/352 |
| 5,330,366 | A | * | 7/1994 | Tsuji et al. | 439/352 |
| 5,564,939 | A | * | 10/1996 | Maitani et al. | 439/352 |
| 5,580,268 | A | * | 12/1996 | Miyazawa | 439/352 |
| 5,580,283 | A | * | 12/1996 | O'Sullivan et al. | 439/352 |
| 5,772,475 | A | * | 6/1998 | Lindeberg | 439/701 |
| 5,779,495 | A | * | 7/1998 | Dachelette et al. | |
| 5,820,399 | A | * | 10/1998 | Shirouzu et al. | 439/352 |
| 6,024,498 | A | * | 2/2000 | Carlisle et al. | |
| 6,033,263 | A | * | 3/2000 | Weidler et al. | 439/620 |
| 6,210,237 | B1 | * | 4/2001 | Chang | 439/676 |

FOREIGN PATENT DOCUMENTS

| | | | |
|---|---|---|---|
| DE | 296 02 268 U1 | * | 11/1996 |
| EP | 0 584 937 B1 | * | 4/1998 |
| EP | 0 863 581 A1 | * | 9/1998 |

* cited by examiner

*Primary Examiner*—Jean F. Duverne
(74) *Attorney, Agent, or Firm*—Harrington & Smith, LLP

(57) ABSTRACT

An electrical connector comprising an insulative body, an electrically conductive terminal received on the insulative body, and electrical shield member disposed in shielding relationship with respect to the terminal, a latching structure integral with the shield member for receiving a latch associated with a mating connector and a second latching structure integral with the shield member for engaging a bracket. There is also a mating connector which has a plurality of peripheral protuberances which preferably contact the panel to improve shielding.

5 Claims, 22 Drawing Sheets

SHIELDED CONNECTOR WITH INTEGRAL LATCHING AND GROUND STRUCTURE

CROSS REFERENCE TO RELATED APPLICATION

This patent application is a divisional application of U.S. patent application Ser. No. 09/211,292, filed Dec. 14, 1998, now U.S. Pat. No. 6,554,646 which relates to U.S. patent application Ser. No. 08/813,555 filed Mar. 7, 1997 now U.S. Pat. No. 5,865,646.

BACKGROUND OF THE INVENTION

1. Field of the Invention

This invention relates to electrical connectors and particularly to shielded, high speed connectors.

2. Brief Description of Prior Developments

As signal speeds, in particularly data transfer speeds, have increased, interconnection systems, such as those used for input output terminals for data processing equipment have had to be designed to pass these higher speed signals within acceptable limits of signal degradation. These efforts have involved shielding and impedance control. Such efforts are typified with connectors, such a modular jacks, that have separate metal shields applied over the connector housing. In many instances, these shields are in two parts, one to cover the body of the connector and the other to be applied over the front face of the connector. Similar approaches have been taken for other connectors, such as the HSSDC connector marketed by AMP, Inc., which is designed to meet the ANSI X3T11 Fiber Channel committee standards. However, as signal speeds have increased, the difficulty of meeting impedance control and shielding requirements by the use of such wraparound shields has increased. An additional complication is that these interconnection systems require reliable contact with shielding structures on the mating plug connectors so that overall performance of the interconnection system is maintained.

Another approach that has been taken is illustrated in recent designs of Universal Serial Bus connectors. Recent designs utilize a central insulative molded member to retain the contacts. The outer shell of this connector comprises a formed sheet metal shield that is wrapped about the molded member and forms the walls of the connector housing. One such connector has been marketed by Berg Electronics under the part number designation 87520.

While the above described connectors have been able to achieve adequate performance in terms of minimizing signal degradation at high frequencies, the drive for ever higher signal frequency has necessitated the development of connectors with higher performance capabilities.

SUMMARY OF THE INVENTION

High speed interconnection performance is assured according to the present invention by incorporating latching features directly into a metal shield of the board mounted receptacle connector. In a preferred embodiment, metal latch engagement surfaces are formed directly from bent portions of the metal shield.

Shielding performance is enhanced by providing opposed laterally extending flanges on the shields. The flanges have interfitting structures arranged along an outer edge or distal so that the flanges of adjacent connectors can be interfit, thereby enhancing shielding integrity and minimizing space requirements.

Contacts for establishing electrical connection between the shield of the receptacle conductor and the mating plug connector have a flexural axis extending generally in alignment with the insertion axis of the mating connector. These contacts are canted inwardly from the shield and can be additionally compliant toward and away from the flexural axis. In a preferred embodiment, these contacts are formed integrally with the sheet metal shield.

Also encompassed within the invention is an electrical connector comprising an insulative body, an electrically conductive terminal received on the insulative body, and electrical shield member disposed in shielding relationship with respect to the terminal, a latching structure integral with the shield member for receiving a latch associated with a mating connector and a second latching structure integral with the shield member for engaging a bracket. There is also a mating connector which has a plurality of peripheral protuberances which preferably contact the panel to improve shielding.

Also encompassed by the invention is an assembly which includes at least one receptacle having a plug receiving opening and being fixed adjacent said opening to a bracket. There is also at least one plug having a front end and a rear end and mated with at least one of the receptacles. A strain relief plate having at least one transverse aperture for receiving at least one of the plugs adjacent its rear end is fastened in spaced relation to the bracket.

Also encompassed by the invention is a plug comprising a conductive contact, a cable receiving means and a front latch for removing the plug from a receptacle; and a horizontal latch for applying pressure to the front latch to remove the plug from the receptacle.

DETAILED DESCRIPTION OF THE PREFERRED EMBODIMENTS

Figure 1:
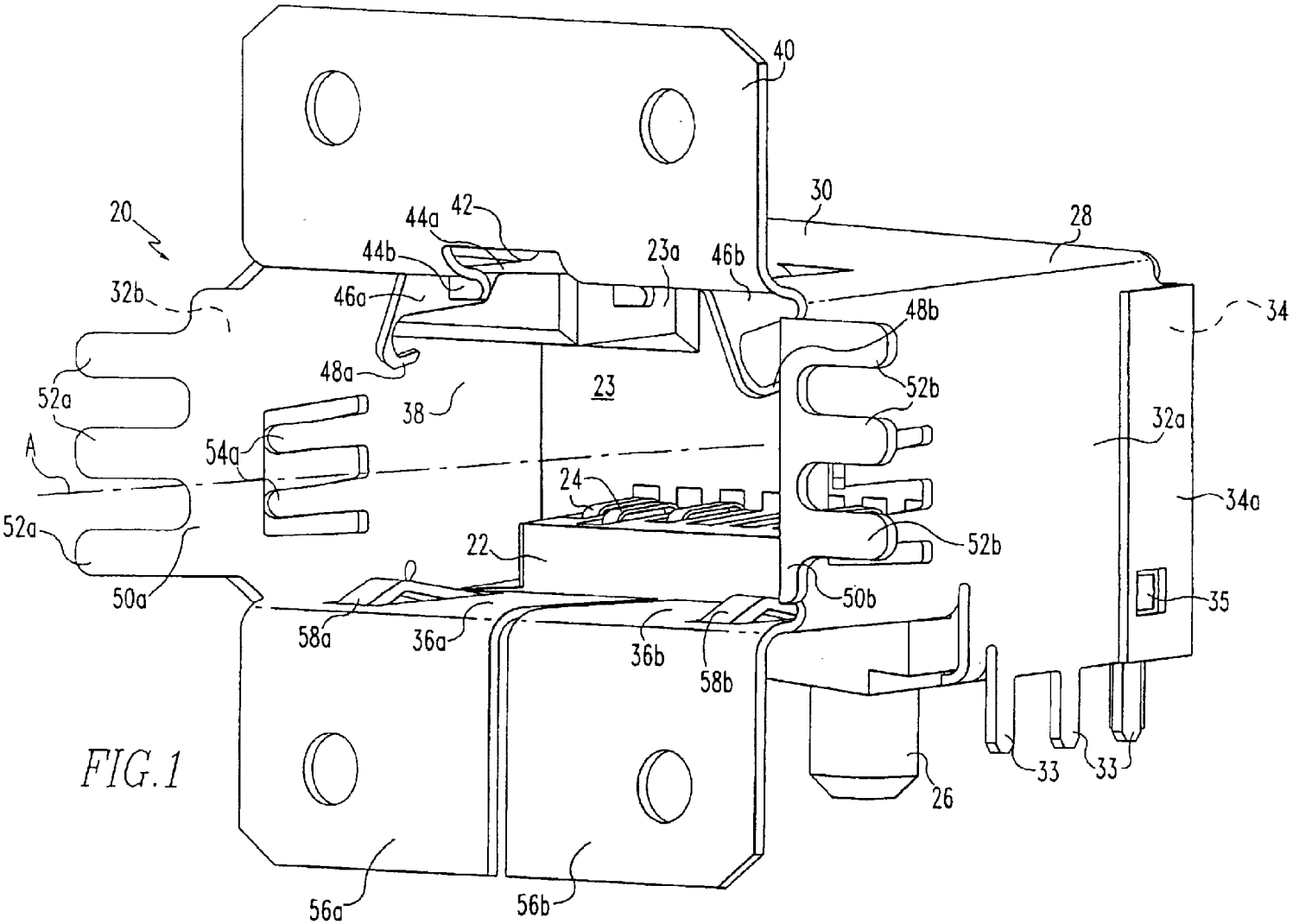
FIG. 1 is an isometric view of the connector embodying features of the invention.
Figure 2:
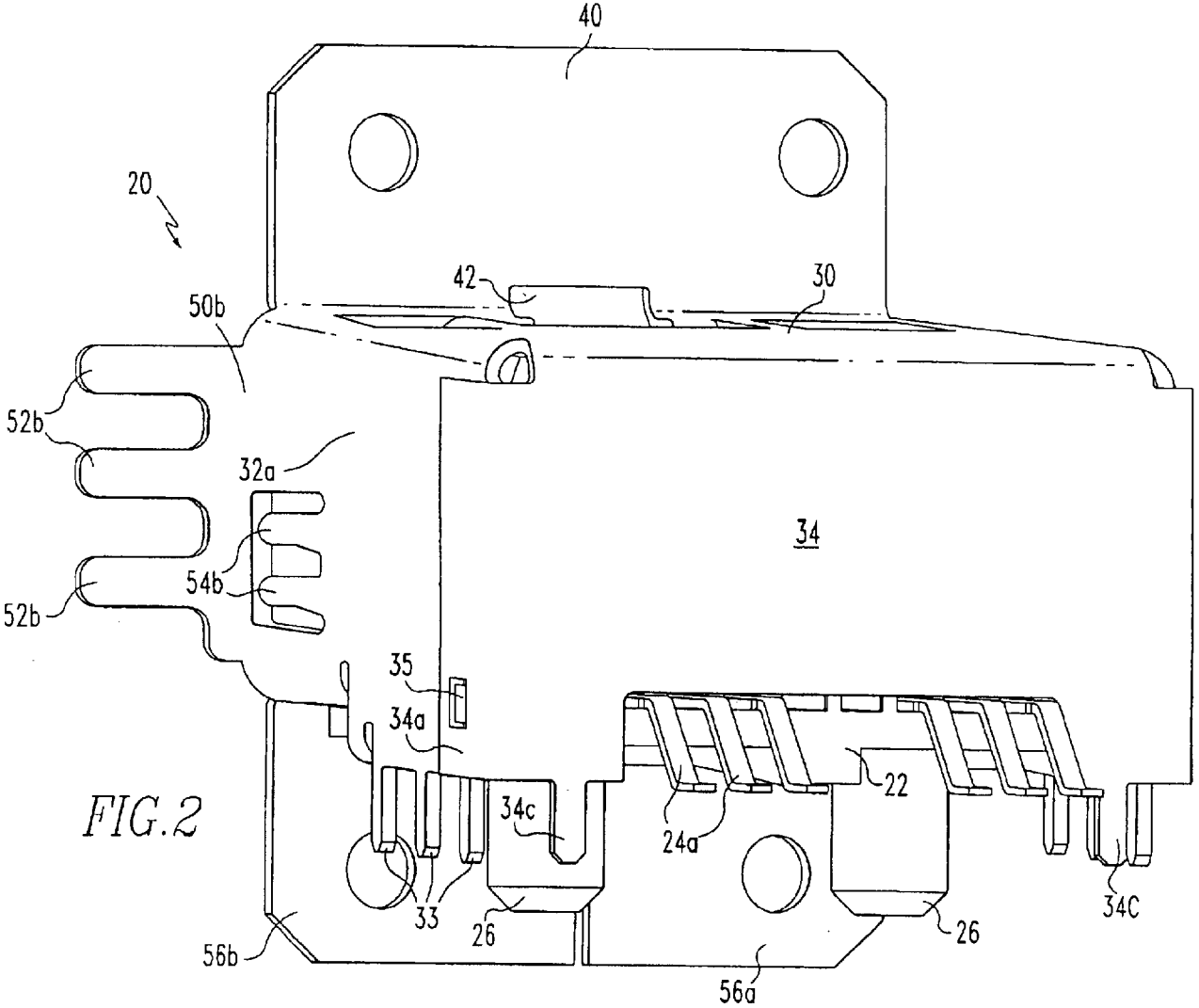
FIG. 2 is a rear isometric view of the connector shown in FIG. 1.

FIG. 1 illustrates a receptacle connector 20. This receptacle comprises a molded plastic contact retaining body 22 having an integral rear wall 23. A plurality of conductive contact terminals 24 are retained on the retainer body 22. The body 22 is molded of a polymeric insulator material. A pair of upper guide members 23*a* (FIGS. 1, 3 and 10) extend forwardly from the wall 23. The tails 24*a* of the terminals 24 extend rearwardly from the body 22 and, as shown, can comprise surface mount tails (FIG. 2). One or more pegs 26 may be integrally molded with insulator 22. The pegs 26 provide location and hold down functions when the connector is mounted on a printed circuit board.

Surrounding the insulator 22 is a shield 28 formed of suitable metallic sheet material. The shield 28 includes a top wall 30, opposed side walls 32*a* and 32*b* and a rear wall 34. Side walls 32*a* and 32*b* include through hole tails 33 adapted to be inserted and soldered or press fit into plated through holes of the circuit board on which the connector is mounted. Back wall 34 carriers similar through hole tails 34*c*. Alternatively the shield tails can be configured for surface mounting. Rear wall 34 also includes tabs 34*a* and 34*b* that are wrapped over the rear portions of the side walls 32*a* and 32*b*. A latch 35 formed on body 22 holds rear wall 34 in position.

The shield 28 also includes bottom wall portions 36*a*, 36*b*. The top wall 30, side walls 32*a*, 32*b* and bottom walls 36*a*, 36*b* define a generally rectangular opening or chamber 38 that is adapted to receive a mating plug connector (later described) adapted to be inserted into the receptacle 20 along the insertion axis A.

The shield also includes a plurality of flanges that extend generally transverse to the direction of the insertion axis A. These include the top flange 40, a bottom flange formed of flange portions 56*a*, 56*b* and a pair of opposed side flanges 50*a*, 50*b*.

Figure 7:
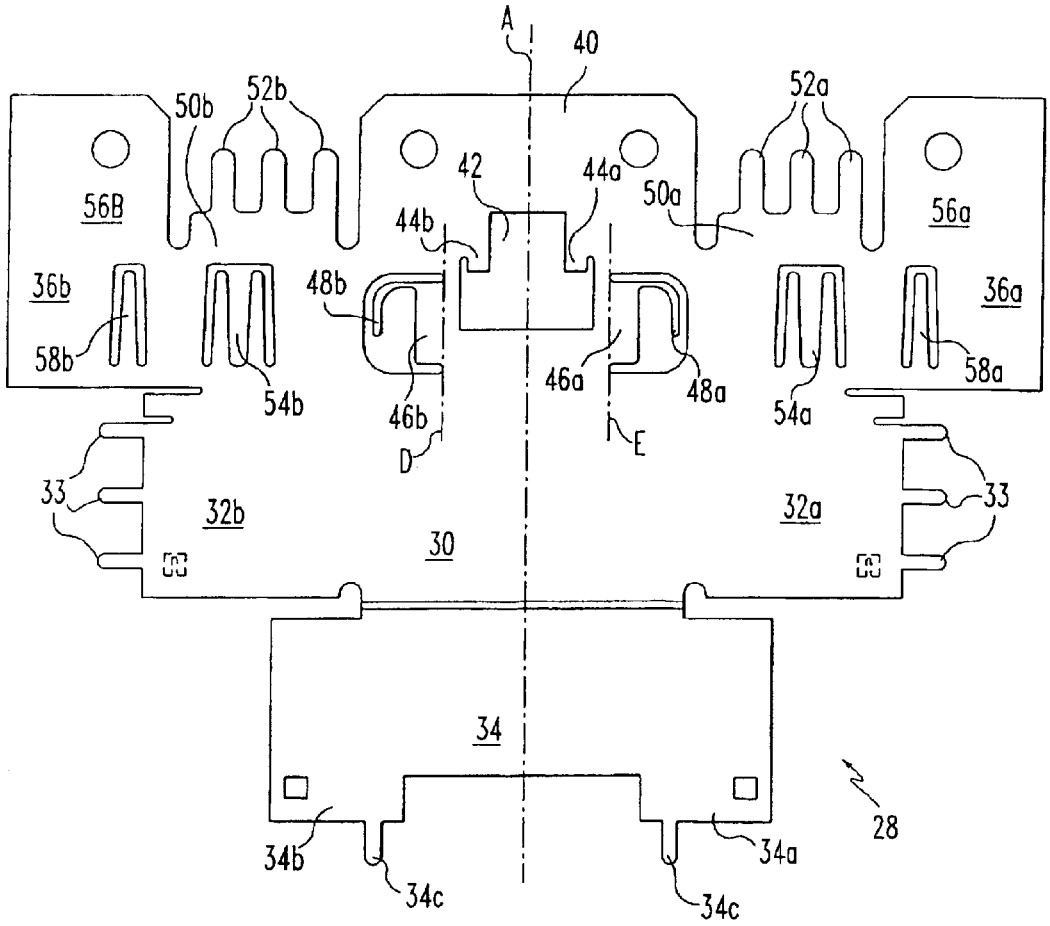
FIG. 7 is a depiction of a stamped shield blank before it is folded to shape.

As shown in FIGS. 1, 2 and 7, a latch receiving slot 42 is formed in the top wall 30 and flange 40. A pair of latching shoulders 44*a*, 44*b* are formed along opposed sides of the slot 42. The shoulders 44*a*, 44*b* are preferably formed by bending to form in-turned tangs that have flat latching surfaces or shoulders that are generally perpendicular to the insertion axis A. This structure is adapted to cooperate with a latch arm mounted on a mating connector, as will be subsequently described. It is also designed to emulate sensory perceptions of such plugs latching into molded plastic housings.

Figure 5:
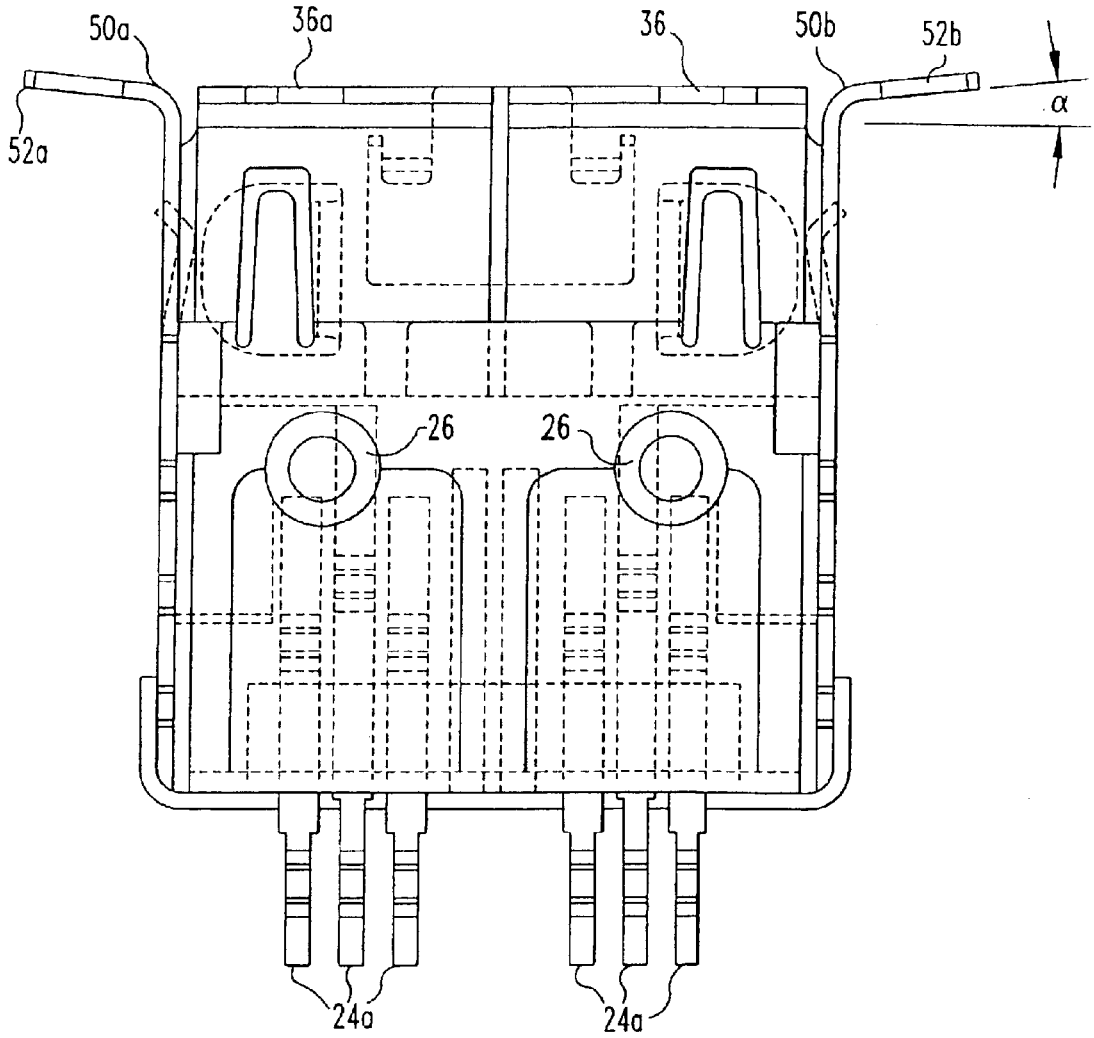
FIG. 5 is a bottom view of the connector shown in FIG. 1.
Figure 6:
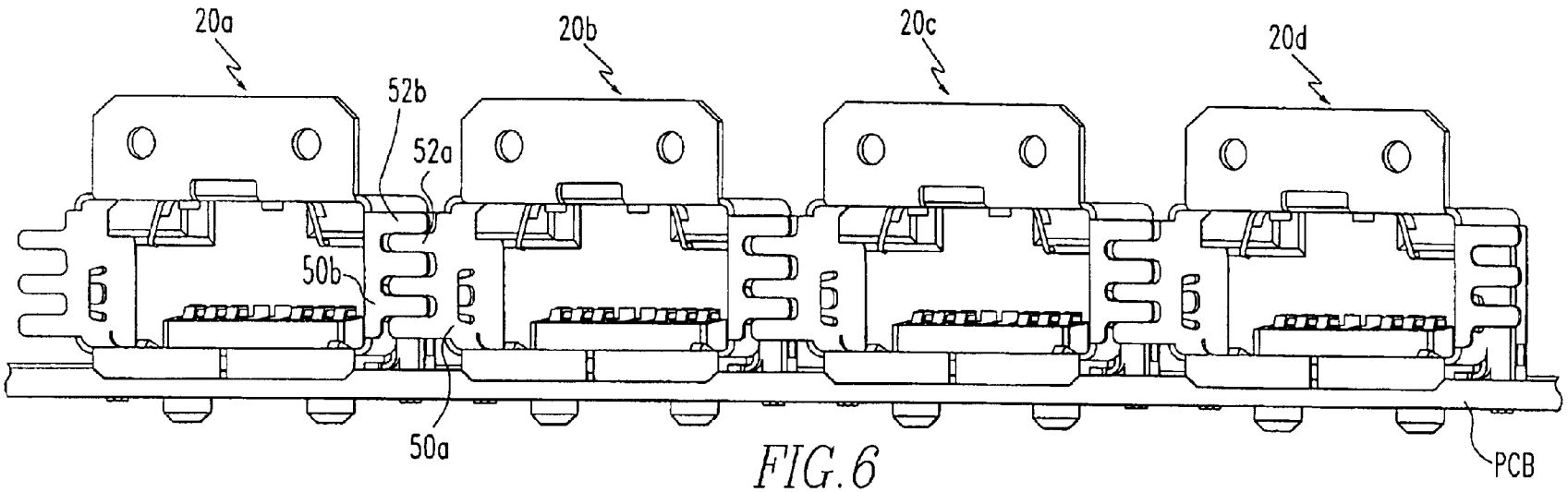
FIG. 6 is an isometric view of four connectors mounted in side by side relationship on a printed circuit board.

Each of the side flanges 50*a*, 50*b* is provided with interfitting sections along the distal edges of the flanges. In the embodiment shown in FIG. 1, these intermitting sections comprise a plurality of fingers 52*a* and 52*b*. The longitudinal axes of the fingers 52*a* are offset from the longitudinal axes of the fingers 52*b* so that, when similar receptacles 20*a*–20*d* (FIG. 6) are placed in side by side relationship, the fingers are interleaved. This improves shielding for the assembled row of connectors and allows closer side by side spacing of the connectors. As shown in FIG. 5, the side flanges 50*a*, 50*b*, are, prior to mounting, disposed at a slight angle a with respect to a transverse plane normal to the insertion axis A. These flanges are adapted to be flexed rearwardly to approximately a right angle position when the flanges are pushed against the back side of an equipment panel (not shown), against which the receptacles 20*a*–20*b* are mounted.

Figure 8:
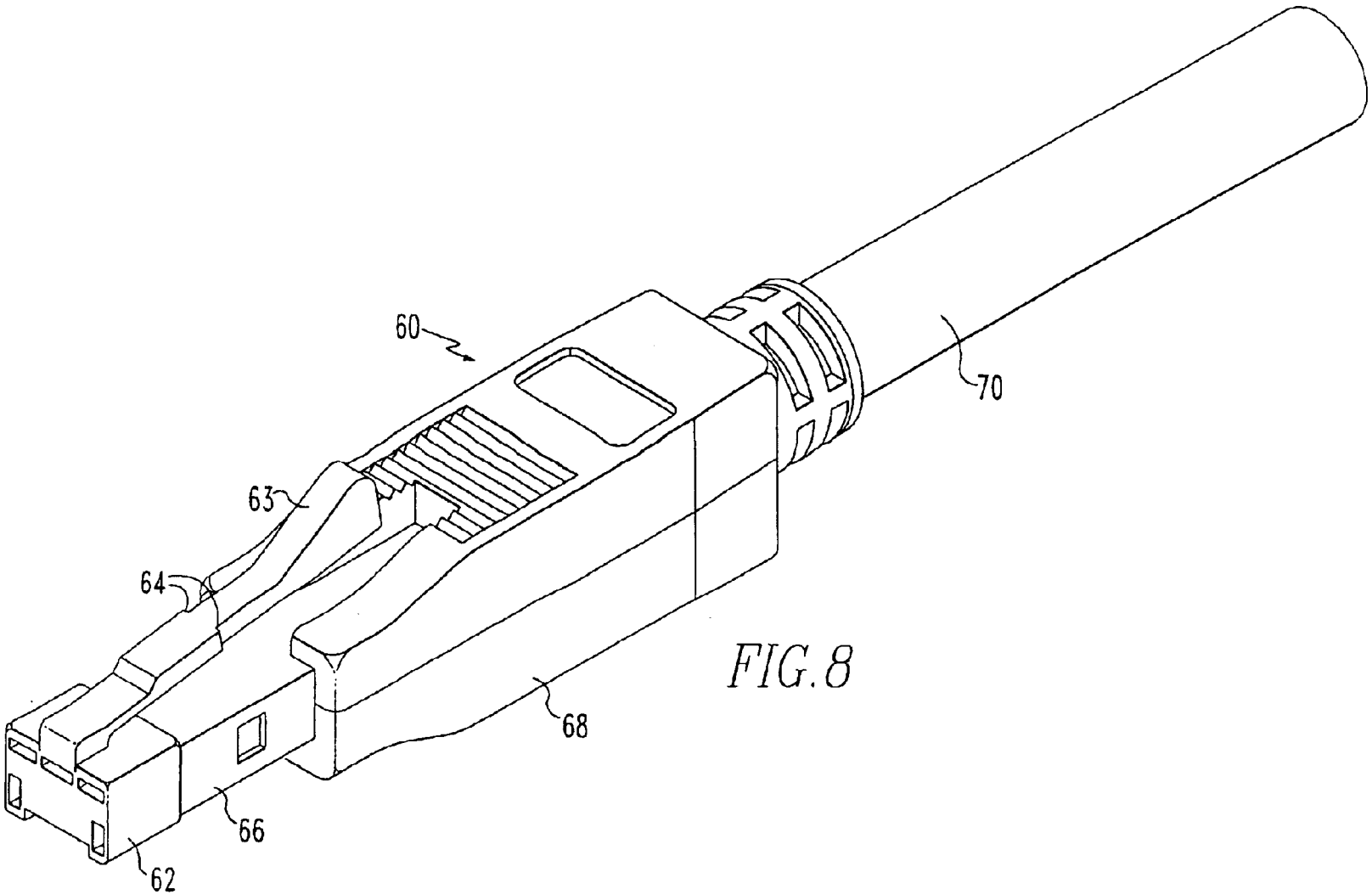
FIG. 8 is a isometric view of a plug connector for mating with the receptacle connector of FIG. 1.

The shield 28 includes a plurality of contacts for assuring electrical connection between the receptacle 20 and a mating plug 60 (FIG. 8). These structures include the top contact members 46*a* and 46*b*, the side contact fingers 54*a* and 54*b*, and the bottom contact members 58*a*, 58*b*. The top contact members 46*a*, 46*b* are formed from the top wall 30 and are canted inwardly into the opening 38 along flexural axes D and E (FIG. 8). As shown in FIG. 7, the flexural axes D and E are preferably parallel to the insertion axis A, but could be disposed in angular relation thereto, up to about a 90° angle.

Figure 3:
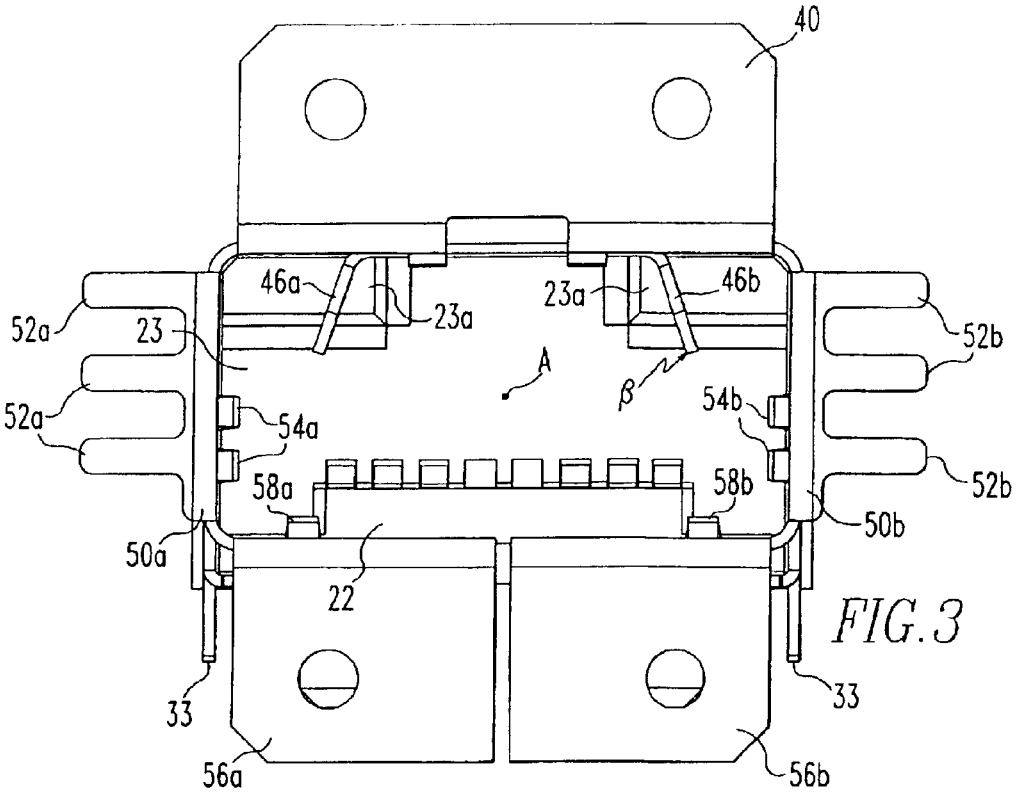
FIG. 3 is a front elevation of the connector shown in FIG. 1.

As shown in FIG. 3, the upper contact members 46*a*, 46*b* are disposed at an angle p with respect to a plane normal to the top wall 30*a*. The contacts 46*a*, 46*b* include compliant contact members 48*a*, 48*b*, preferably in the form of cantilevered arms that can be flexed toward the flexural axes D and E respectively.

A plurality of forwardly extending contacts 54*a*, 54*b* are formed in the side walls 32*a*, 32*b* respectively. These contact fingers are positioned to engage side walls of the mating plug. Contact between the bottom walls 36*a*, 36*b* and the bottom surface of the plug is achieved through forwardly extending contact fingers 58*a*, 58*b*. Thus it can be seen that electrical contact is established between the top, bottom and side walls of the receptacle 20 and the plug 60.

Figure 4:
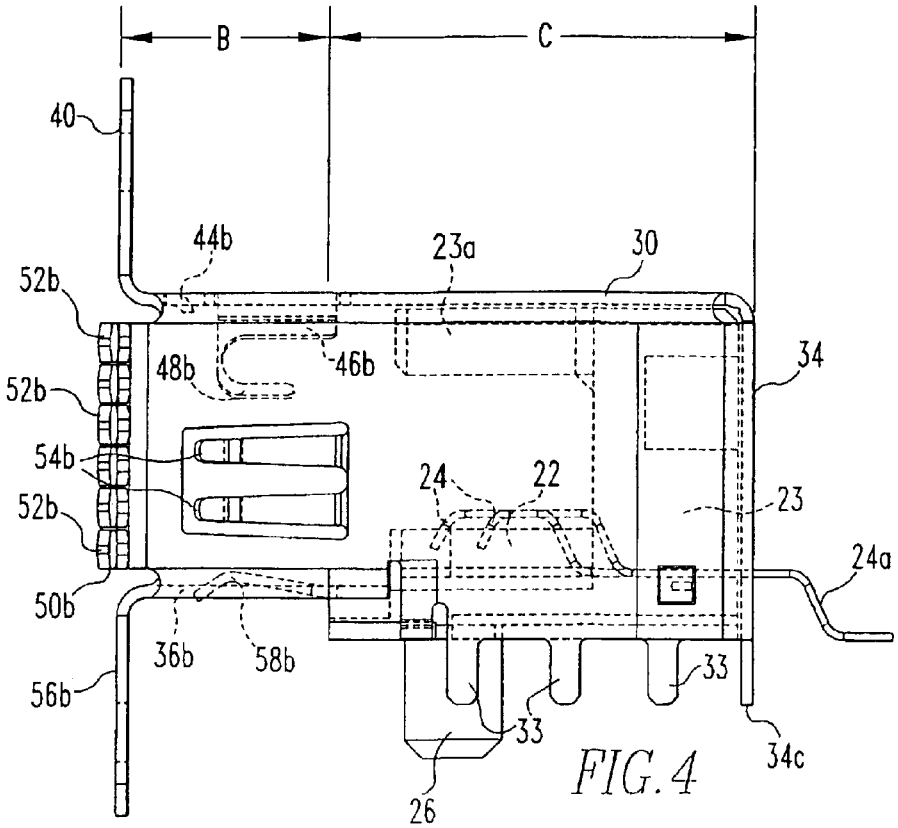
FIG. 4 is a side elevation of the connector of FIG. 1.

As shown in FIG. 4, the shield 28 includes a front zone B, wherein the mating plug is surrounded on all four sides by the metal shield, and a rear zone C, wherein the insulator 22 is surrounded at the top and on the sides by the shield 28. The arrangement of the shield sections and surrounding relationship of the contacts 46*a*, 46*b*, 54*a*, 54*b*, and 58*a*, 58*b* ensures a low impedance connection between the shield 28 (and ultimately the printed circuit board) and the plug 60.

FIG. 7 illustrates the flat blank from which the shield 28 is formed. As can be seen from FIGS. 1 and 2, the back wall 34 is formed by bending downwardly along the junction between wall 34 and top section 30. The tabs 34*a*, 34*b* are formed by bending the tabs forwardly at approximately a 90° angle to the back wall 34. Side walls 32*a*, 32*b* are formed by bending along the top wall edges generally parallel with insertion axis A. Similarly, bottom walls 36*a*, 36*b* are formed by bending the shield along the junctions between the sections 36*a*, 36*b* and the side walls 32*a*, 32*b*. The flanges 40, 50*a*, 50*b*, and 56*a*, 56*b*, are similarly formed by bending from the blank shown in FIG. 1. As well, the contact elements 46*a*, 46*b*, 54*a*, 54*b* and 58*a*, 58*b* are formed by stamping and bending from the blank shown in FIGS. 1 and 2.

Referring to FIG. 8, a typical mating plug connector 60 is illustrated. This plug includes an insulative nose section 62 that serves as an insulator for contacts (not shown) that are carried on the bottom side of the nose and engage the receptacle contacts 24. The nose is preferably formed of an insulative polymeric material. A latch arm 63, having latching surfaces 64, is preferably integrally molded with the nose 62. The plug includes a metallic shield section 66 that surrounds the conductors within the plug from the nose 62 rearwardly toward the cable 70. The plug includes an overmold section 68 utilized primarily for gripping the plug.

Figure 9:
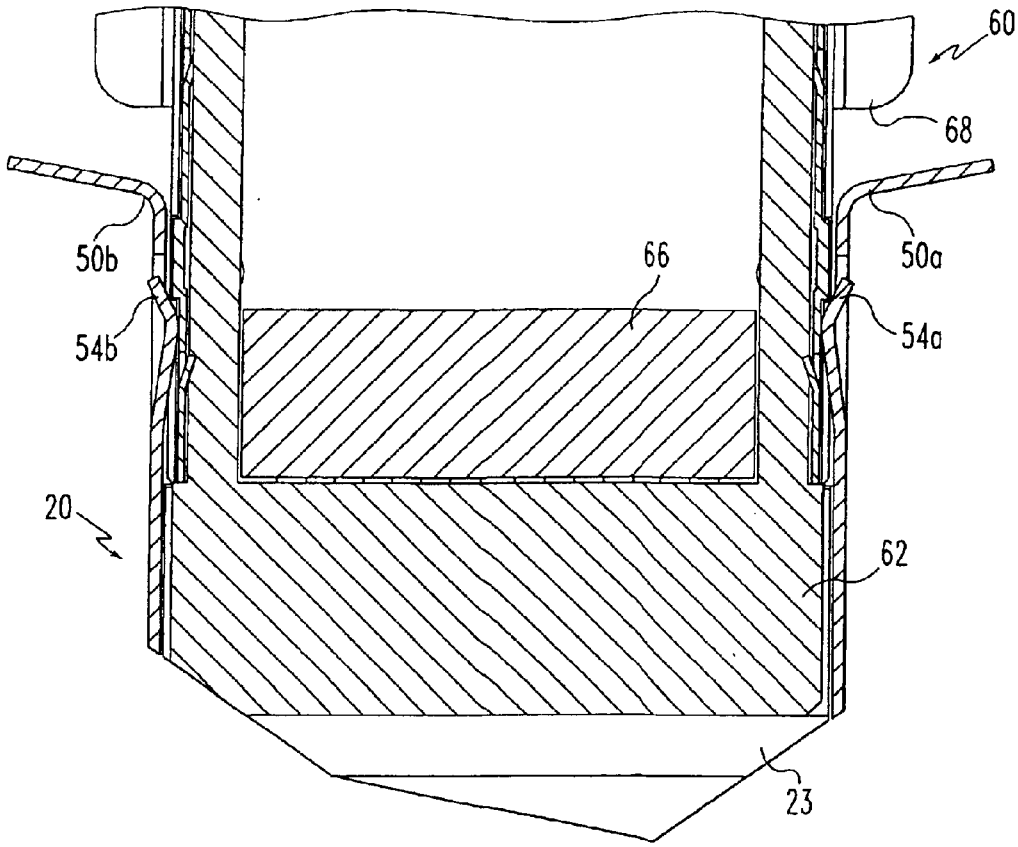
FIG. 9 is a fragmentary cross-sectional top view showing the plug connector of FIG. 8 inserted into the receptacle connector of FIG. 1.

As shown in FIG. 9, when the plug 60 is inserted into the receptacle 20 in its fully mated position, the side contacts 54*a*, 54*b* engage the side walls of the shield 66 to establish an electrical connection therewith. In this position, the front wall of the nose section 62 is positioned against the wall 23 of insulator 22. The nose section is held in vertical location by the body 22 and the guide sections 23*a*.

Figure 11:
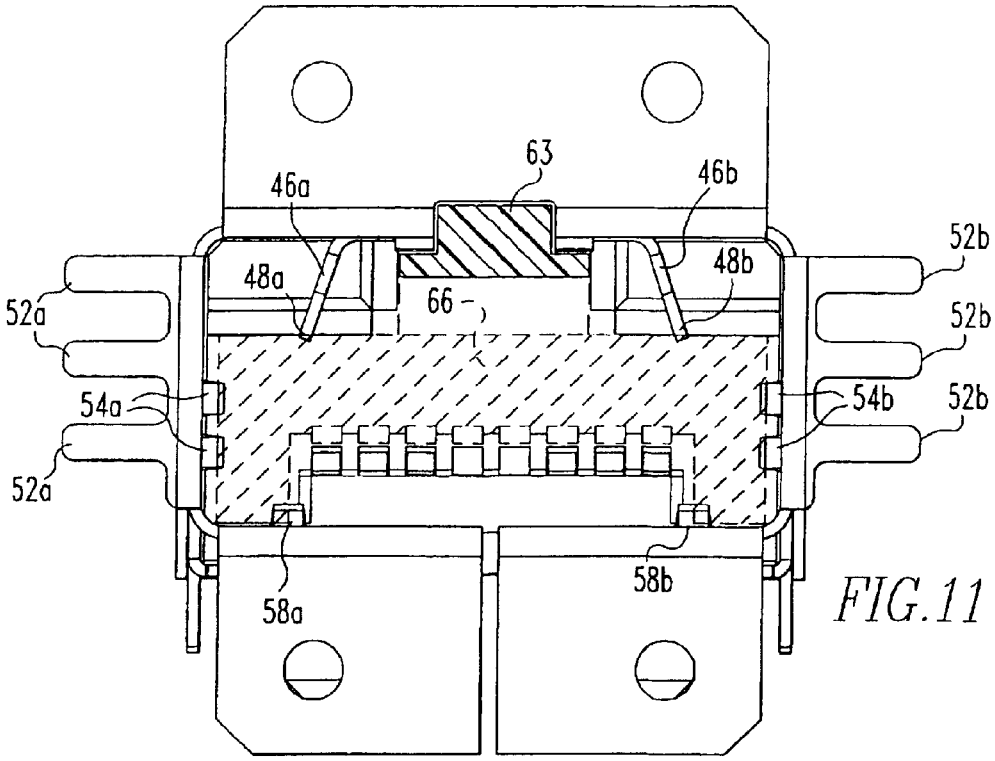
FIG. 11 is a front elevational view of the connector shown in FIG. 1 with the plug of FIG. 8 shown (in cross-section) in mated condition.
Figure 10:
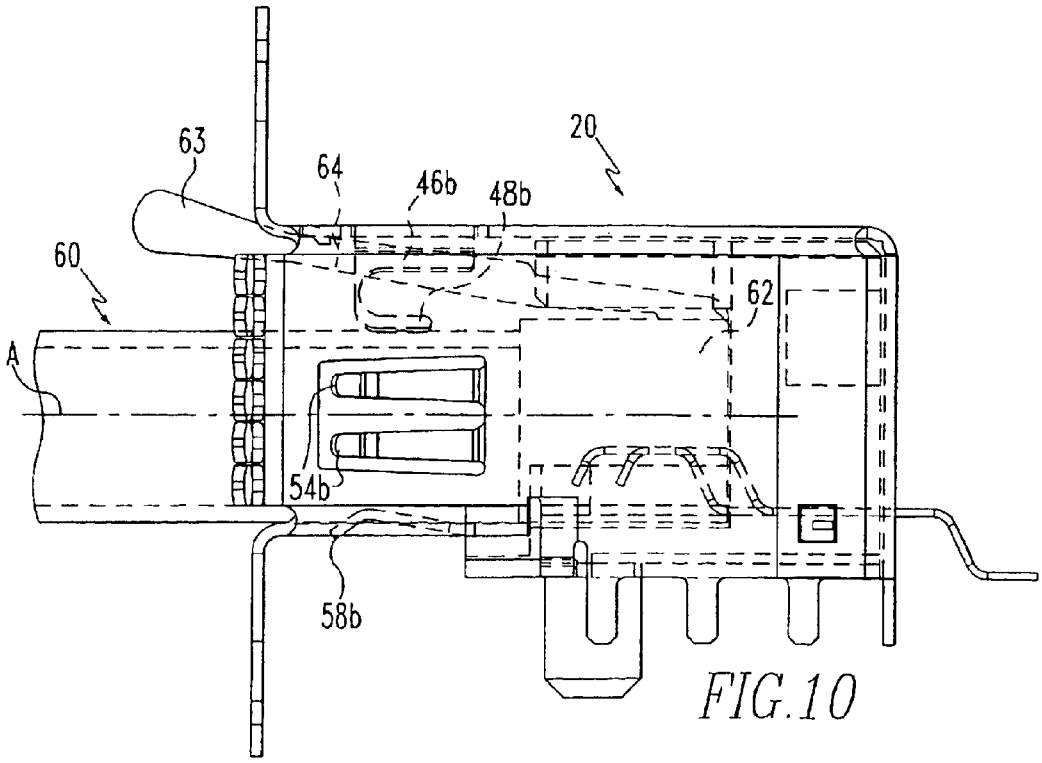
FIG. 10 is a side view of the receptacle connector of FIG. 1 with the plug connector of FIG. 8 mated in the receptacle.
Figure 12:
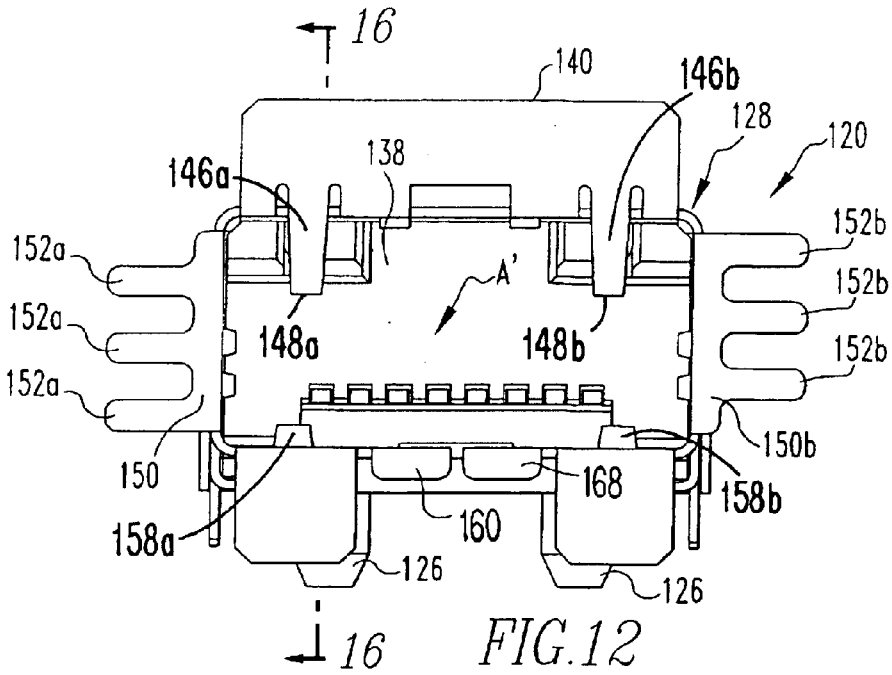
FIG. 12 is a front elevational view of a connector representing a second preferred embodiment of the present invention.
Figure 15:
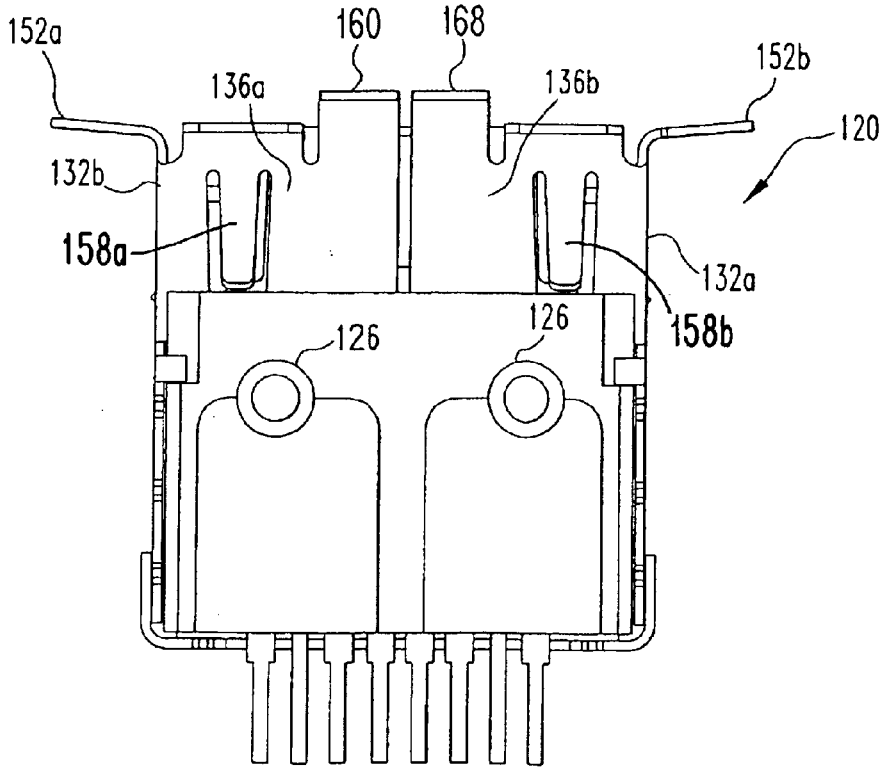
FIG. 15 is a bottom plan view of the connector shown in FIG. 12.
Figure 14:
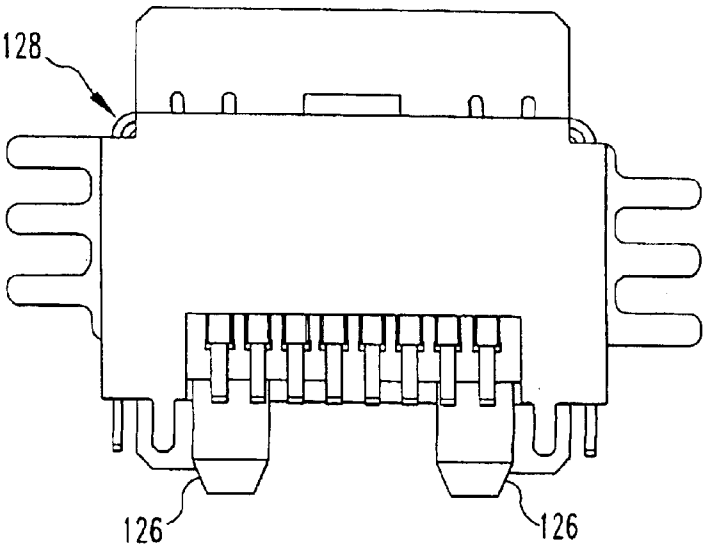
FIG. 14 is a rear elevational view of the connector shown in FIG. 12.
Figure 13:
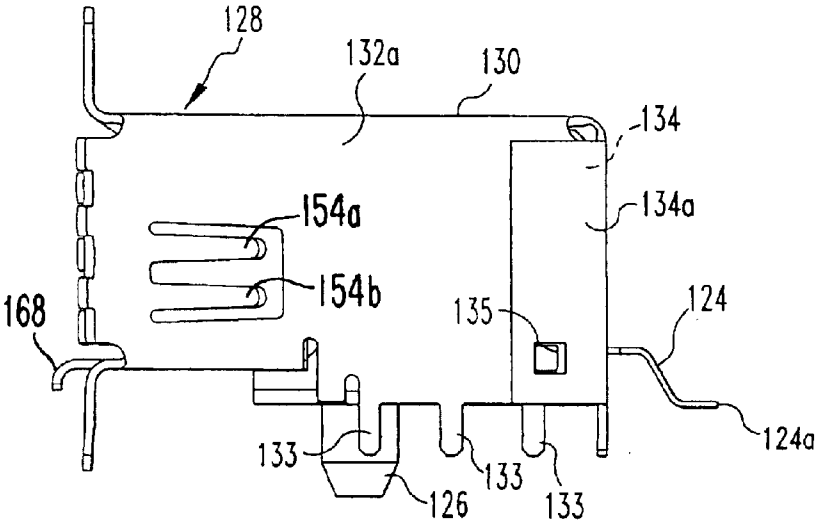
FIG. 13 is a side elevational view of the connector shown in FIG. 12.
Figure 16:
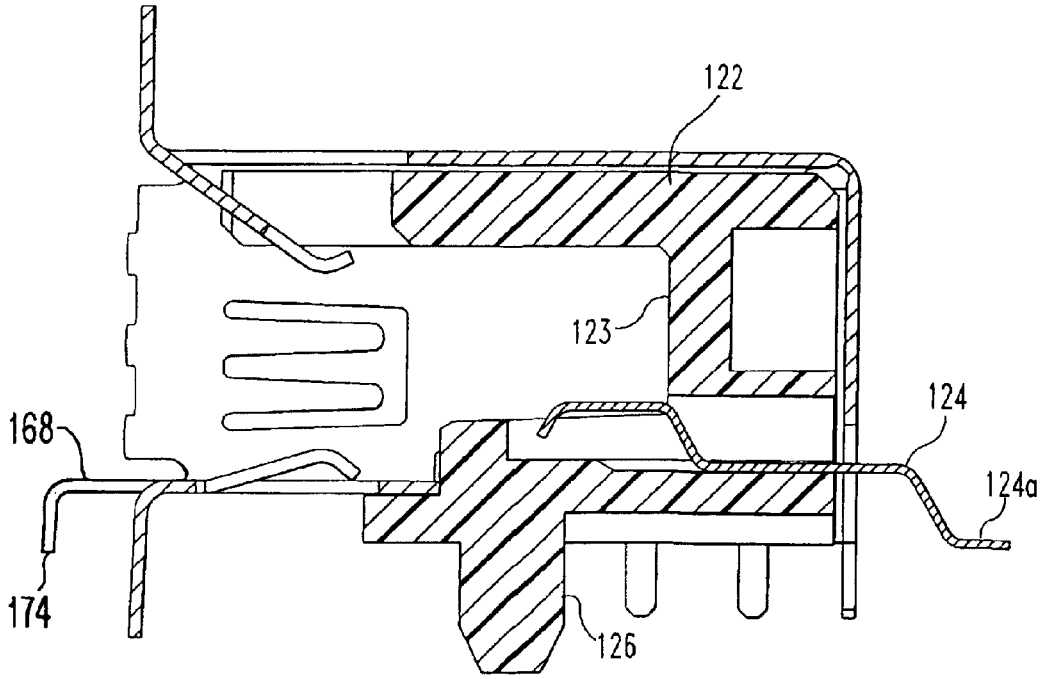
FIG. 16 is a cross sectional view through 16—16 in FIG. 12.
Figure 18:
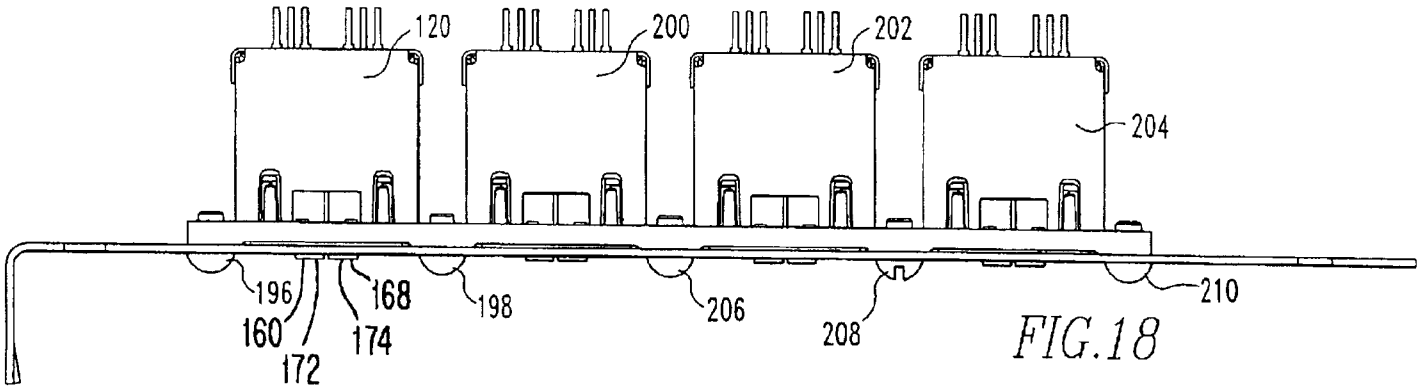
FIG. 18 is a top plan view of the assembly shown in FIG. 17.
Figure 17:
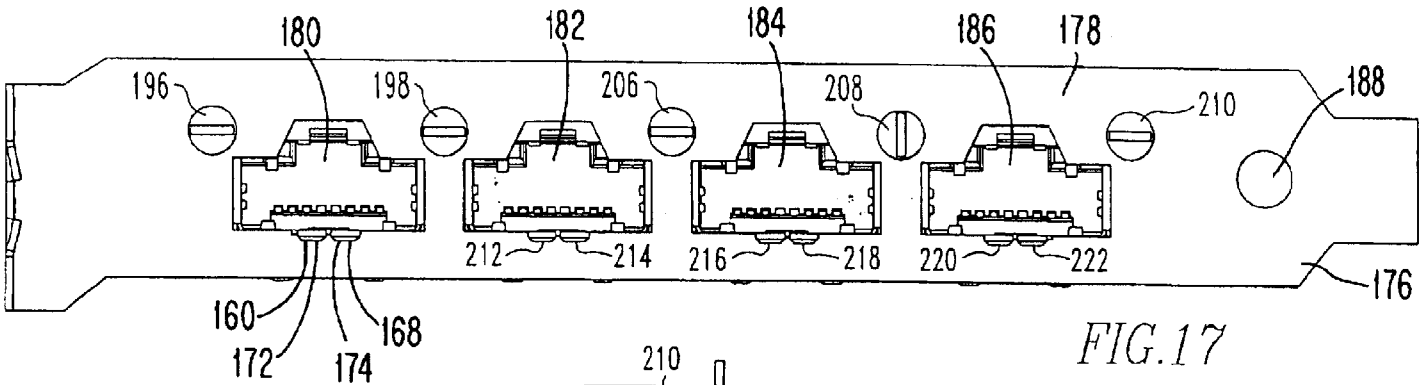
FIG. 17 is a front elevational view of an assembly comprising a plurality of connectors like the one shown in FIG. 12 which are mounted on a peripheral computer interface (PCI) bracket.
Figure 19:
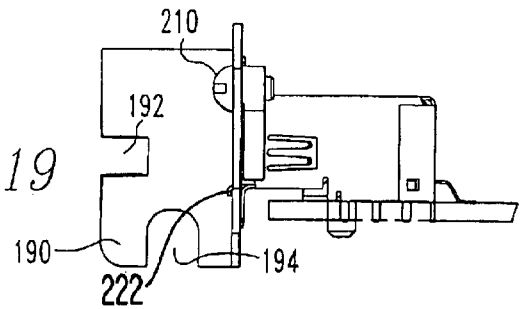
FIG. 19 is an end view of the assembly shown in FIG. 17.

As shown in FIG. 10, when the plug 60 is in fully mated position within the receptacle 20, the top contact 46*a*, 46*b* engage the top wall of shield 66 via the cantilever arms 48*a* and 48*b*. Similarly, the forwardly extending bottom contact members 58*a*, 58*b* engage the bottom surface of the shield 66. As shown in FIG. 11, in the mated position, the top contact members 46*a* and 46*b* touch the top surface of the shield 66 of the plug. The upper contacts 46*a*, 46*b* are capable of being deflected by rotation about the flexural axes D and E respectively and by compliance of the cantilevered arms 48*a*, 48*b*. This structure allows the generation of substantial normal forces by the upper contacts 46*a* and 46*b* within the relatively limited axial length of the zone B of shield 28.

As can be realized particularly from FIGS. 4 and 8, the plug 60 and receptacle 20 are held in mated condition by the engagement of the latch surfaces 64 with the bent latch tangs 44*a*, 44*b*. Release of the plug is permitted by pressing the latch arm 63 downwardly toward the shield 66 to release the surfaces 64 from the tangs 44*a*, 44*b*.

The described features above result in an interconnection system that has improved shielding and overall lower impedance. As a result, higher signal frequencies can be passed through this interconnection system within acceptable levels of signal degradation. The improved performance is believed to result, at least in part, by minimization of the length of ground paths from the plug to the printed circuit board as a result of the location and/or orientation of the various grounding contacts formed in the shield.

The latching structure described provides essentially the same tactile feel and aural sensation as achieved with latch structures formed in molded plastic housings. Thus the user has the same sensory perceptions that occur when the plug latch assumes the latched position or is unlatched with the disclosed structure as with previous molded receptacle housings.

FIGS. 12–16 illustrate another preferred receptacle connector 120. This receptacle comprises a molded plastic contact retaining body 122 having an integral rear wall 123. A plurality of conductive contact terminals 124 are retained on the retainer body 122. The body 122 is molded of a polymeric insulator material. A pair of upper guide members 123*a* (FIG. 12) extend forwardly from the wall 123. The tails 124*a* of the terminals 124 extend rearwardly from the body 122 and, as shown, can comprise surface mount tails. One or more pegs 126 may be integrally molded with insulator 122. The pegs 126 provide location and hold down functions when the connector is mounted on a printed circuit board.

Surrounding the insulator 122 is a shield 128 formed of suitable metallic sheet material. The shield 128 includes a top wall 130, opposed side walls 132*a* and 132*b* and a rear wall 134. Side walls 132*a* and 132*b* include through hole tails 133 adapted to be inserted and soldered or press fit into plated through holes of the circuit board on which the connector is mounted. Back wall 134 carriers similar through hole tails 134*c*. Alternatively the shield tails can be configured for surface mounting. Rear wall 134 also includes tabs 134*a* and 134*b* that are wrapped over the rear portions of the side walls 132*a* and 132*b*. A latch 135 formed on body 122 holds rear wall 134 in position.

The shield 128 also includes bottom wall portions 136*a*, 136*b*. The top wall 130, side walls 132*a*, 132*b* and bottom walls 136*a*, 136*b* define a generally rectangular opening or chamber 138 that is adapted to receive a mating plug connector (later described) adapted to be inserted into the receptacle 120 along the insertion axis A.

The shield also includes a plurality of flanges that extend generally transverse to the direction of the insertion axis A. These include the top flange 140, a bottom flange formed of flange portions 156*a*, 156*b* and a pair of opposed side flanges 150*a*, 150*b*.

As shown in FIGS. 1, 2 and 7, a latch receiving slot 142 is formed in the top wall 130 and flange 140. A pair of latching shoulders 144*a*, 144*b* are formed along opposed sides of the slot 142. The shoulders 144*a*, 144*b* are preferably formed by bending to form in-turned tangs that have flat latching surfaces or shoulders that are generally perpendicular to the insertion axis A. This structure is adapted to cooperate with a latch arm mounted on a mating connector, as will be subsequently described. It is also designed to emulate sensory perceptions of such plugs latching into molded plastic housings.

Each of the side flanges 150*a*, 150*b* is provided with interfitting sections along the distal edges of the flanges. In the embodiment shown in FIG. 1, these interfitting sections comprise a plurality of fingers 152*a* and 152*b*. The longitudinal axes of the fingers 152*a* are offset from the longitudinal axes of the fingers 152*b* so that, when similar receptacles 120*a*–120*d* are placed in side by side relationship, the fingers are interleaved. This improves shielding for the assembled row of connectors and allows closer side by side spacing of the connectors. Like in the first embodiment, the side flanges 150*a*, 150*b*, are, prior to mounting, disposed at a slight angle a with respect to a transverse plane normal to the insertion axis A. These flanges are adapted to be flexed rearwardly to approximately a right angle position when the flanges are pushed against the back side of an equipment panel (not shown), against which the receptacles 120*a*–120*b* are mounted.

The shield 128 includes a plurality of contacts for assuring electrical connection between the receptacle 120 and a mating plug. These structures include the top contact members 146*a* and 146*b*, the side contact fingers 154*a* and 154*b*, and the bottom contact members 158*a*, 158*b*. The top contact members 146*a*, 146*b* are formed from the top wall 130 and are canted inwardly into the opening 138 along flexural axes D and E. The flexural axes D and E are preferably parallel to the insertion axis A, but could be disposed in angular relation thereto, up to about a 90° angle. Similar to the first embodiment, the upper contact members 146*a*, 146*b* are disposed at an angle with respect to a plane normal to the top wall 130*a*. The contacts 146*a*, 146*b* include compliant contact members 148*a*, 148*b*, preferably in the form of cantilevered arms that can be flexed toward the flexural axes D and E respectively.

A plurality of inwardly and rearwardly extending contacts 154*a*, 154*b* are formed in the side walls 132*a*, 132*b* respectively. These contact fingers are positioned to engage side walls of the mating plug. Contact between the bottom walls 136*a*, 136*b* and the bottom surface of the plug is achieved through inwardly and rearwardly extending contact fingers 158*a*, 158*b*. Thus, it can be seen that electrical contact is established between the top, bottom and side walls of the receptacle 120 and the plug in a way similar to the first embodiment.

The connector receptacle 120 also has a pair of parallel latches 168 and 160 which extend in a forward direction to engage a bracket as is explained hereafter. These latches have respectively forward terminal flanges 172 and 174 which overlap the engaging bracket.

Referring to FIGS. 17–21 the receptacle connector 120 is shown mounted on a PSI bracket 176. The PSI bracket has a major planar area 178 with a number of receptacle connector port openings 180, 182, 184 and 186. The major planar area also has a mounting aperture 188. The PSI bracket 176 also includes a perpendicular planar area 190 which has mounting features 192 and 194. Receptacle connector is affixed to the PSI bracket 176 by means of fasteners 196 and 198 positioned in opposed relation adjacent its lateral sides. Another receptacle connector 200 is mounted over opening 182. A third receptacle connector 202 is mounted over opening 184, and a fourth receptacle connector 204 is mounted over opening 186. Fastener 206 along with fastener 198 retains receptacle connector 200 on the PSI bracket 176. Fasteners 206 and 208 receptacle connector 204 is retained on the PSI bracket 176 by means of fastener 208 and 210. Receptacle connector 200 is also connected at its lower side to PSI bracket 176 by means of latches 212 and 214. Receptacle connector 202 is also connected to the PSI bracket 176 at its lower side by means of latches 216 and 218. Receptacle connector 204 is similarity connected to the PSI bracket by means of latches 220 and 222.

Figure 20A:
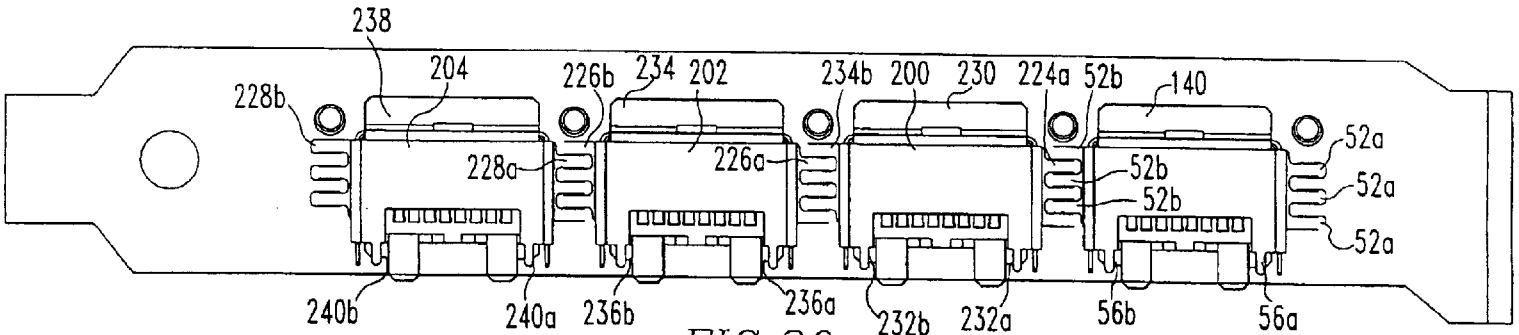
FIG. 20*a* is a rear elevational view of the assembly shown in FIG. 12 in which the rear attachment bracket has not yet been fixed to the assembly.

Referring particularly to FIG. 20*a*, it will be seen that fingers 52*a* and 52*b* bear against the PSI bracket. Fingers 52*b* interlock with fingers 224*a* of receptacle connector 200. Fingers 224*b* of receptacle connector 200 interlock with fingers 226*a* of receptacle connector 202. Fingers 226*b* of receptacle connector 202 interlock with fingers 228*a* of receptacle connectors 204. Fingers 228*b* of receptacle connector 204 bear against the PSI bracket. Also bearing against the PSI bracket are upper flange 140 and lower flanges 56*a* and 56*b* of receptacle connector 120. Similarly connector 200 has an upper flange 230 and lower flanges 232*a* and 232*b* bearing against the PSI bracket and receptacle connector 202 has an upper flange 234 and lower flanges 236*a* and 236*b* bearing against the bracket. Receptacle connector 204 has an upper flange 238 and lower flanges 240*a* and 240*b* bearing against the PSI bracket.

Figure 20B:
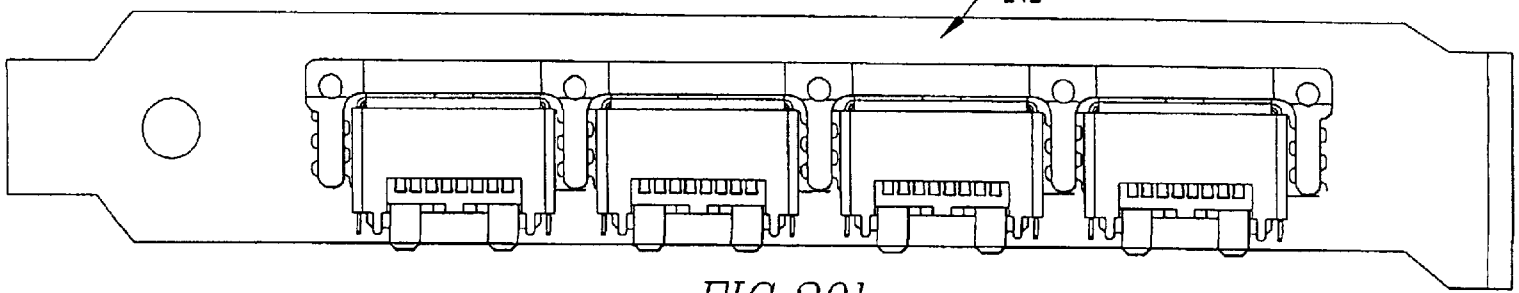
FIG. 20*b* is a rear elevational view of the assembly shown in FIG. 17 in which the rear attachment bracket has been fixed to the assembly.
Figure 21:
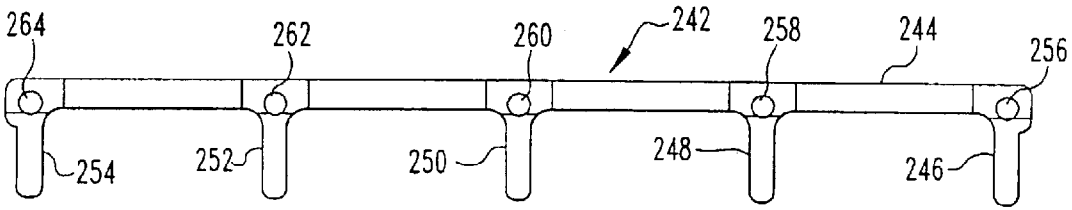
FIG. 21 is a front elevational view of the rear attachment bracket shown in FIG. 20*b;*
Figure 24:
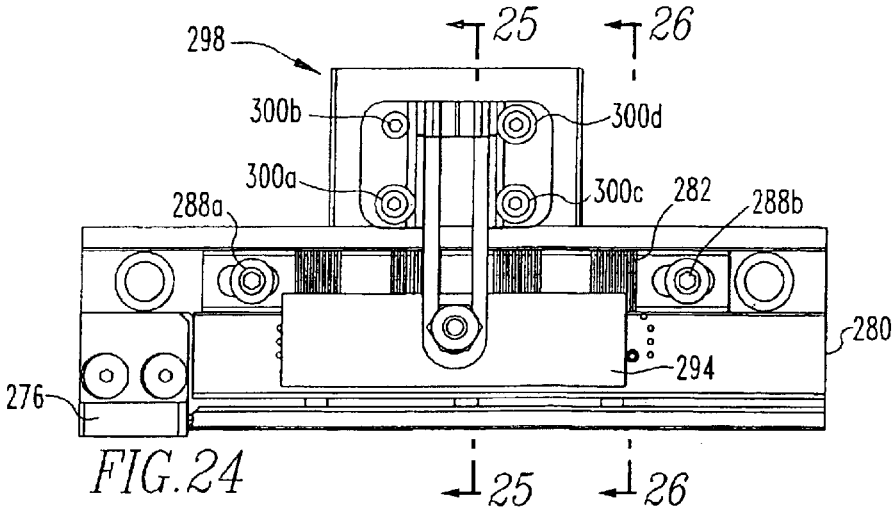
FIG. 24 is a top plan view of the assembly shown in FIG. 22.
Figure 22:
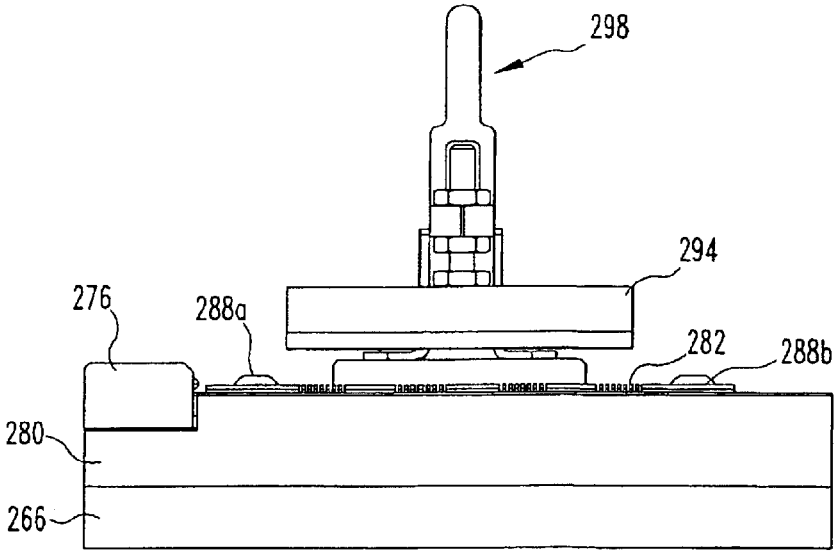
FIG. 22 is a front elevational view of a tool used to attach the connector shown in FIG. 12 to a PCI bracket in the manufacture of the assembly shown in FIG. 17.
Figure 23:
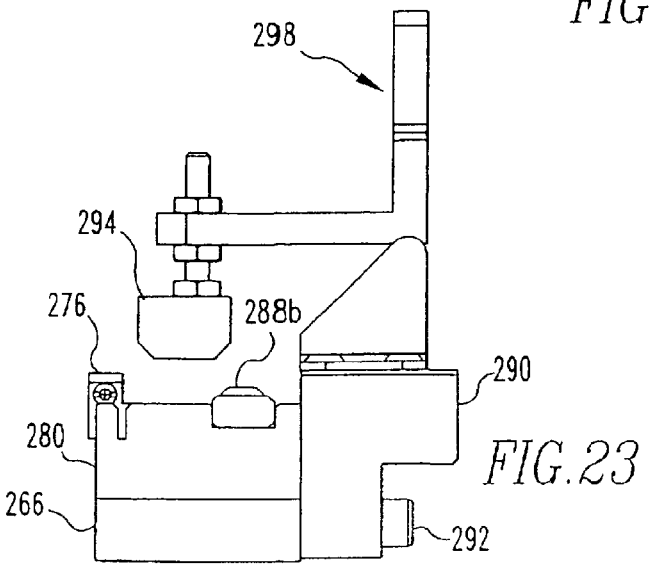
FIG. 23 is a side elevational view of the tool shown in FIG. 22.
Figure 25:
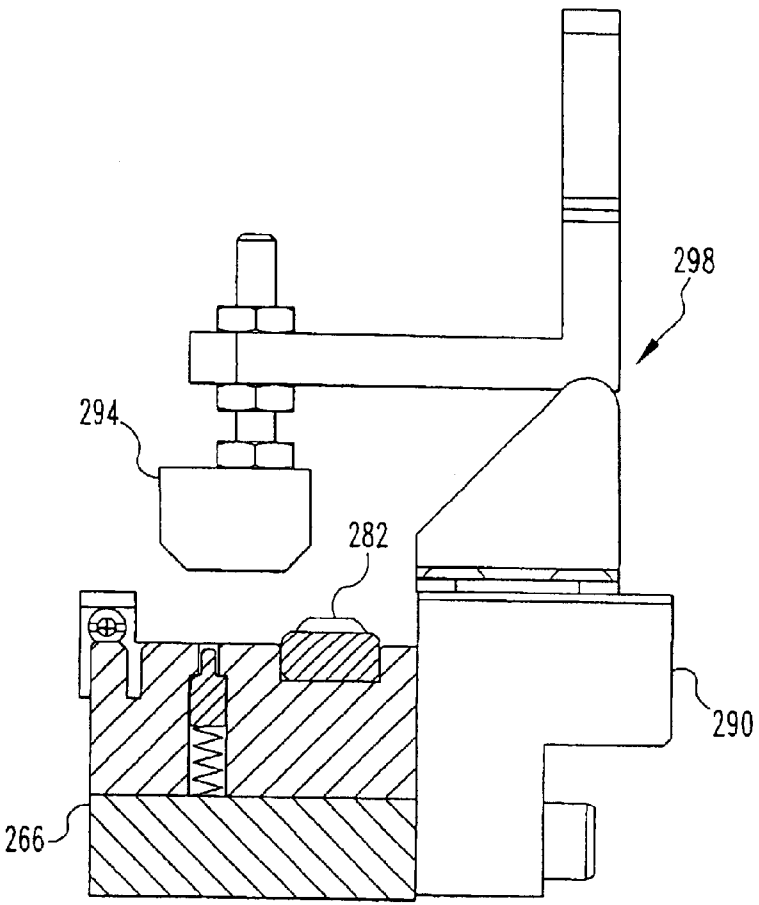
FIG. 25 is a cross sectional view through 25–25 and 24.
Figure 26:
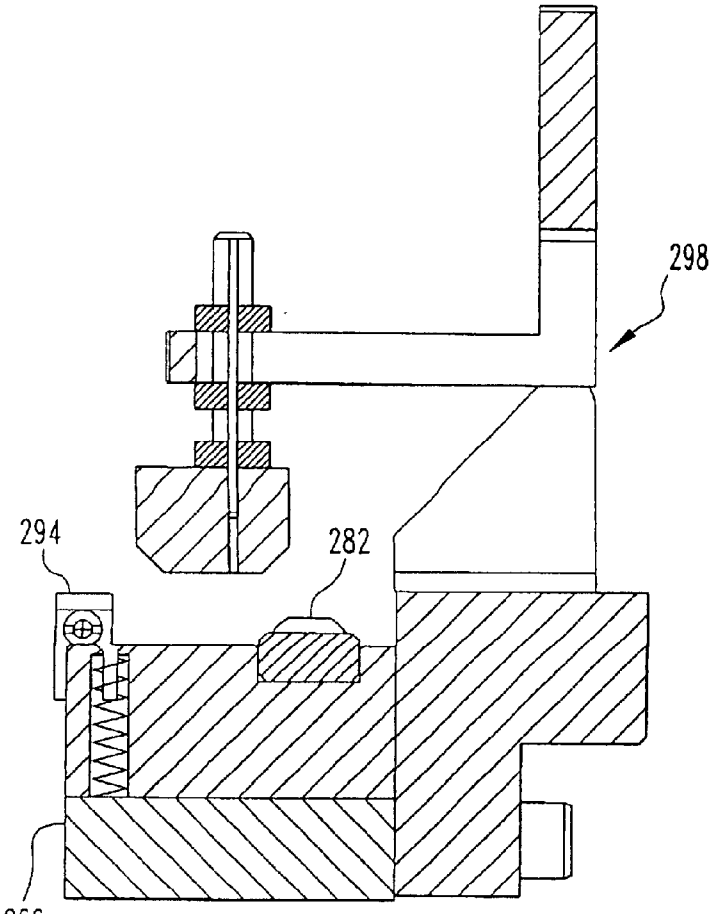
FIG. 26 is a cross sectional view through 26–26 in FIG. 26.
Figure 27:
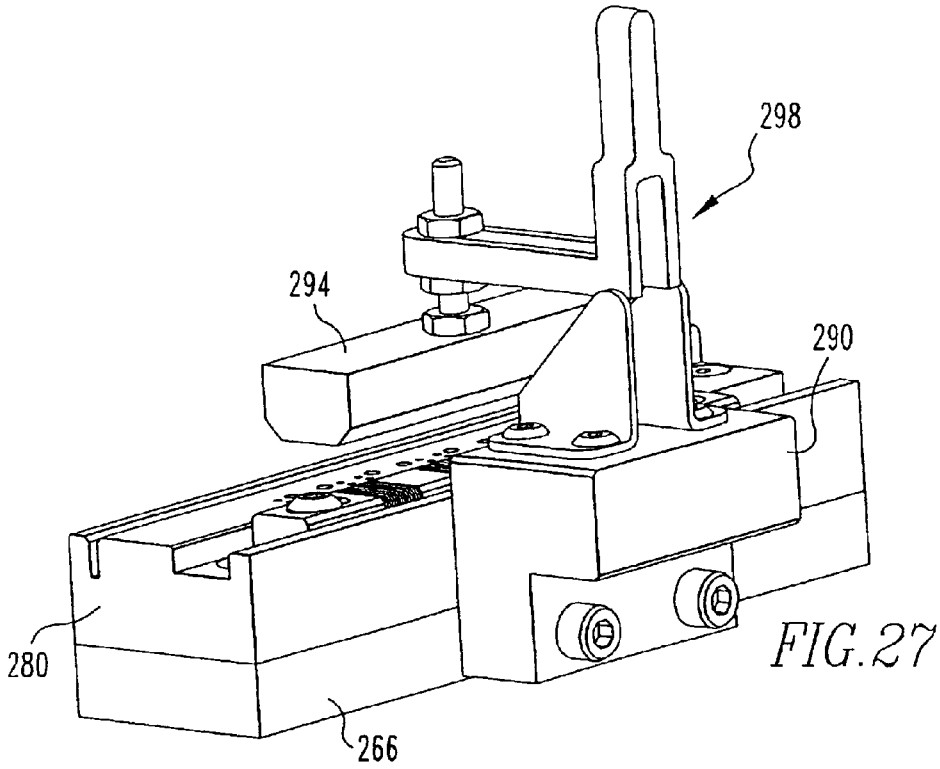
FIG. 27 is a rear perspective view of the tool shown in FIG. 22.
Figure 28:
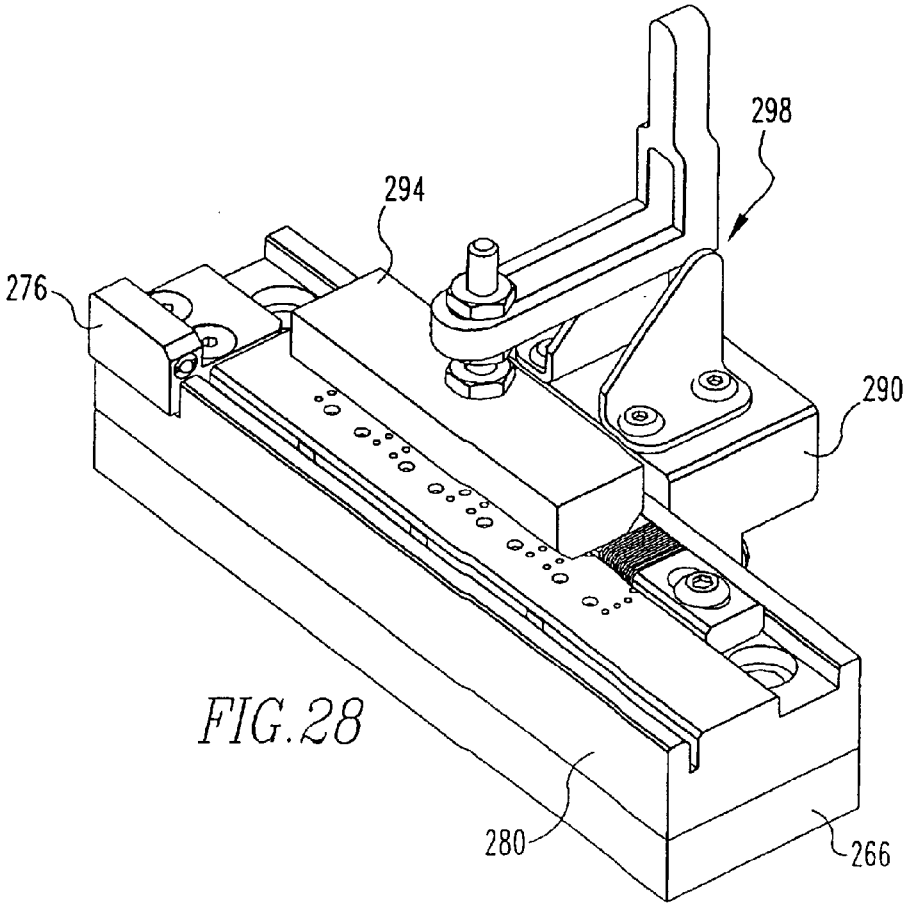
FIG. 28 is a front perspective view of the tool shown in FIG. 28.
Figure 29:
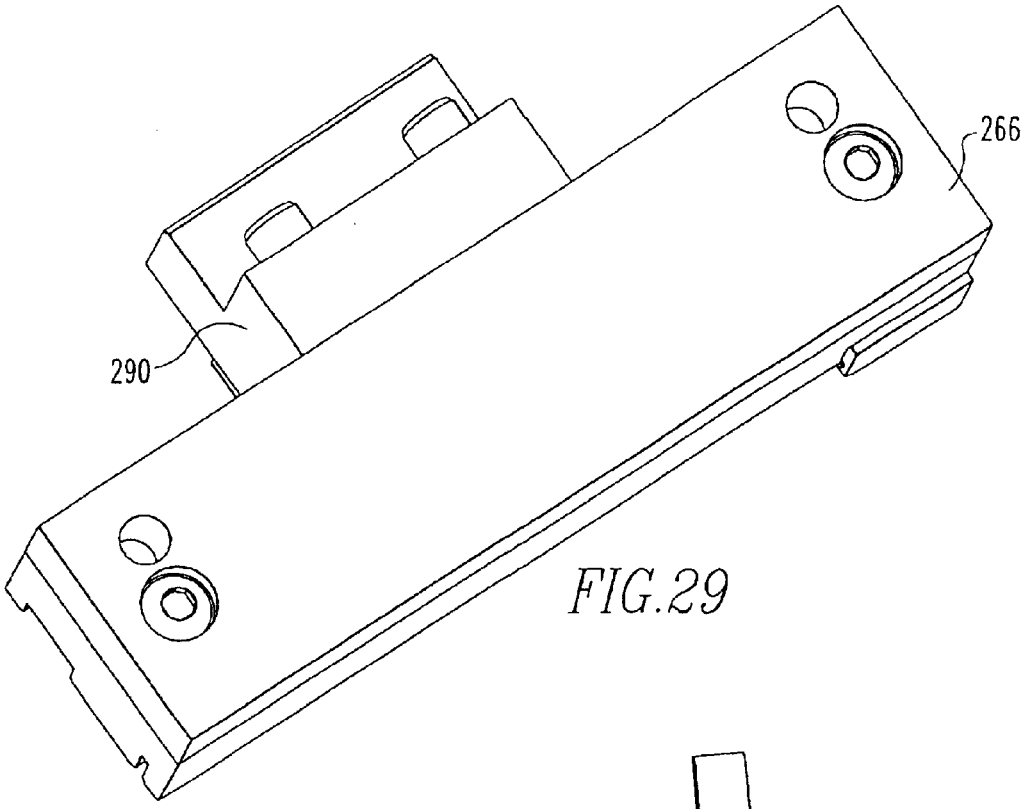
FIG. 29 is a bottom perspective view of the tool shown in FIG. 22.
Figure 30:
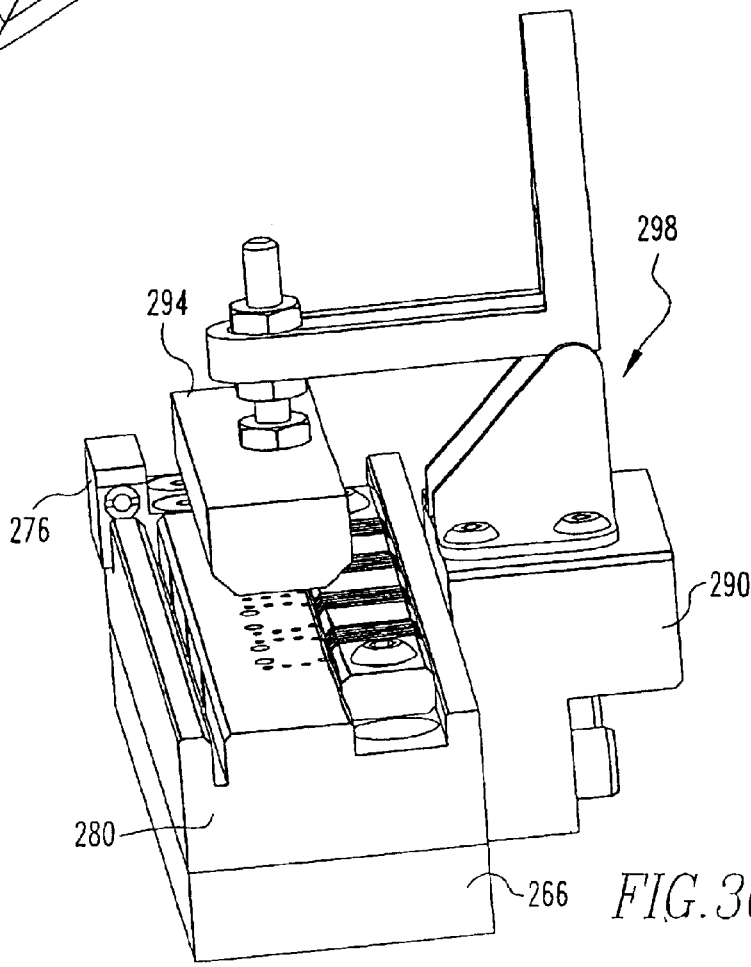
FIG. 30 is a side perspective view of the tool shown in FIG. 22.
Figure 31:
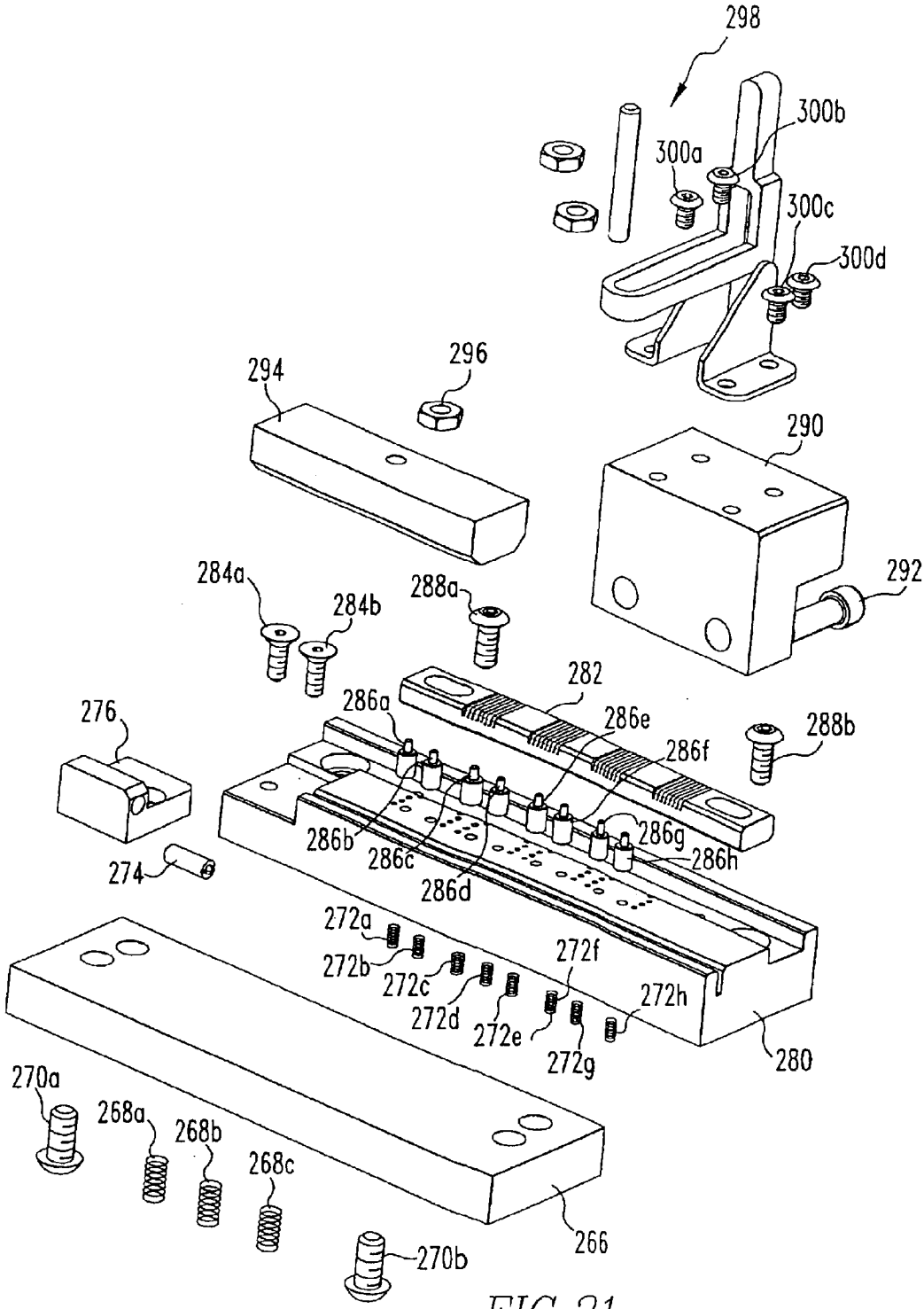
FIG. 31 is a front exploded view of the tool shown in FIG. 22.
Figure 32:
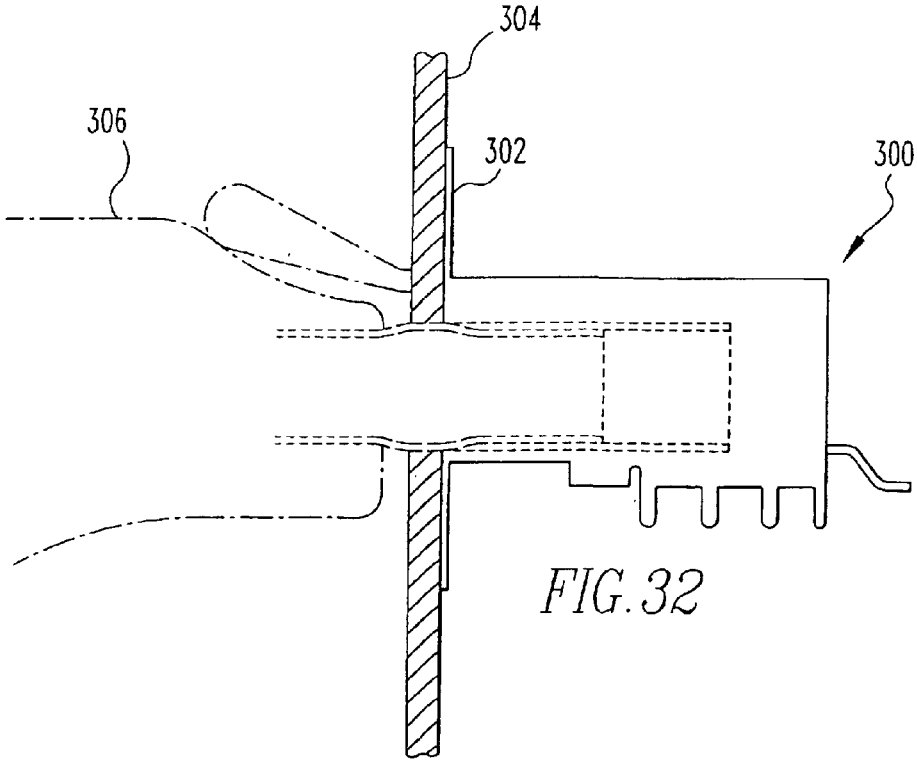
FIG. 32 is a side schematic view of the receptacle described above mated with an improved plug.
Figure 33:
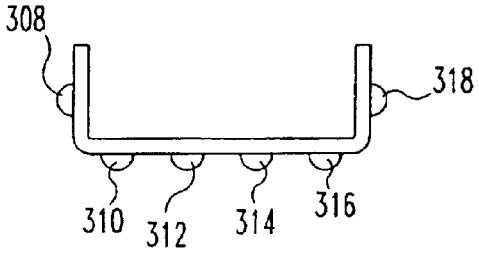
FIG. 33 is a vertical cross section of the lower section of the improved plug.
Figure 34:
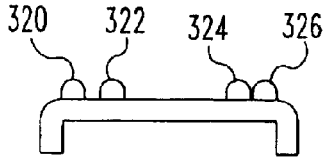
FIG. 34 is a vertical cross section of the upper section of the improved plug.
Figure 35:
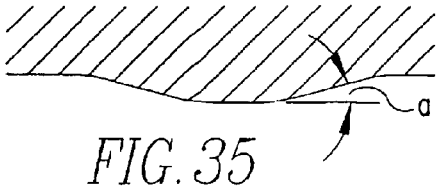
FIG. 35 is a longitudinal cross section of a protuberance on the improved plug.

Referring particularly to FIG. 20*b*, an attachment bracket shown generally at 242 is superimposed over the upper flanges and the interlocking fingers of the receptacle connectors. This attachment bracket 242 has a horizontal member 244 and legs 246, 248, 250, 252 and 254. Above each of these legs there is a fastener receiving aperture 256, 258, 260, 262 and 264. These apertures receive respectively fasteners 196, 198, 206, 208 and 210.

Referring to FIGS. 24–31, the apparatus for mounting the receptacle shown in FIGS. 12–16 on the printed circuit board (PCB). This apparatus includes a base plate 266 which includes PCI eject springs 268*a*, 268*b* and 268*c*. The base plate 266 is also connector to the rest of the assembly by means of fasteners 270*a* and 270*b*. Superimposed over the base plate there are connector peg springs 272*a*–272*h*. There is a ball plunger 274 mounted in a ball plunger housing 276 which along with ejector pegs 278 is mounted on an alignment plate 280. Superimposed on the base plate there is a connector spacer 282 and fasteners 284 and 284*b*, ejector pegs 286*a*–286*b* and fasteners 288 and 288*b*. Also superimposed on the alignment plate is a clamp bracket 290 which is attached to the apparatus assembly by means of bolts as at 292. The apparatus assembly also includes a hold-down block 294 and a fastening nut 296 as well as a clamp assembly shown generally at 298 which is held to the clamp bracket 290 by means of fasteners 300*a*, 300*b*, 300*c* and 300*d*.

Up to four receptacle as is shown in FIGS. 12–16 may be mounted on a PCI bracket. The contact support plate which has a series of slots is used to accurately position or re-position any of the contact tails as the connectors are being loaded into the fixture. A vertical clamp is used to hold the connectors in place. A spring loaded plunger and a series of internal springs in the base are used to accurately position the PCI bracket with respect to the connectors. Once located, the PCI bracket is permanently attached to the connectors using a support bracket and machine screws. The clamp is then removed which allows the eject pins to lift out the fixture with the completed PCI bracket.

Referring to FIGS. 32–35, an improved means of connecting the receptacle described above to a preferably shielded plug is shown. The receptacle described above is shown schematically at numeral 300 and is fixed to a bracket 302 which is mounted on panel bulkhead 304. The plug is shown schematically at numeral 306. The lower section of the plug has peripheral protuberances 308, 310, 312, 314, 316 and 318. The upper section of the plug has peripheral protuberances 320, 322, 324 and 326. In many situations angle a in FIG. 35 will be about 15°. In many applications the protuberances will be about 0.022 in height and about 0.060 in length. Preferably, the protuberances will contact the panel. It is found that these protuberances provide improved shielding.

Figure 36:
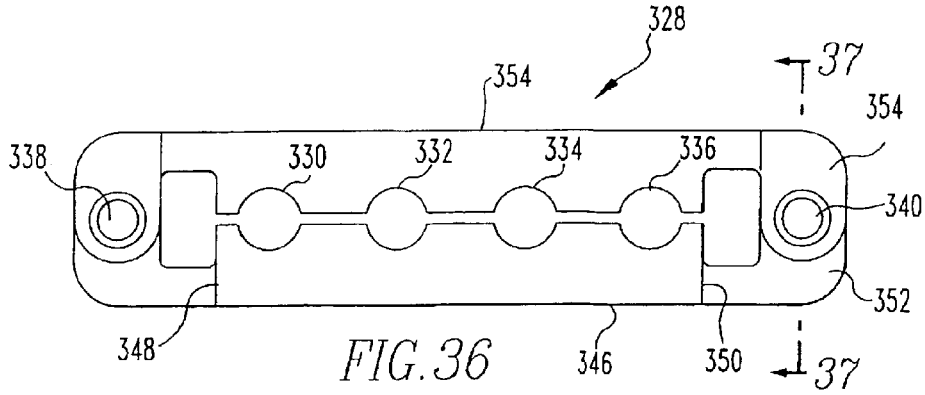
FIG. 36 is a plate used to release stress in a plug similar to the one shown in FIG. 42.
Figure 37:
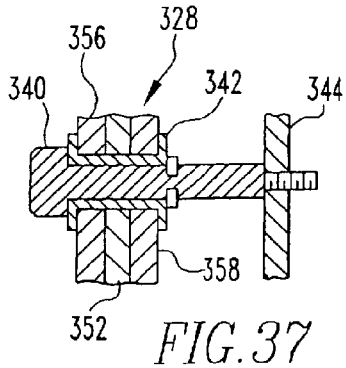
FIG. 37 is a cross sectional view through 37–37 in FIG. 36.
Figure 38:
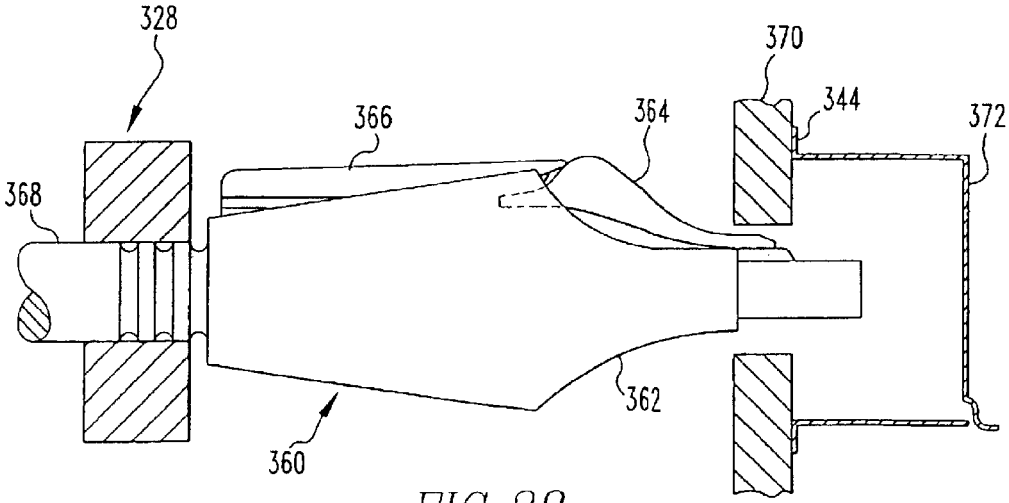
FIG. 38 is a side elevational view of a plug used in conjunction with the strain relief plate and a receptacle.

Referring to FIGS. 36–38, an improved means of providing strain relief for plugs mated with the receptacle described above is shown. The strain relief bracket is shown generally at numeral 328. This bracket has a plurality of apertures 330, 332, 334, and 336, each of which apertures can receive one plug in the way described below. Fasteners 338 and 340 and rivets as at rivet 342 pass through the bracket 382 to attach it to a receptacle bracket 344 as was described above. The strain relief bracket 382 has a lower section 346 with outwardly downward steps 348 and 350. At each edge there is a thin central plate 352. The strain relief bracket 382 also includes an upper plate 354 which at its edges has spaced downwardly extending parallel plates 356 and 358 which receive the upper plate 354 of the lower section 346 between them. Referring to FIG. 38, a plug is shown generally at numeral 360. This plug includes an insulative housing 362, a front latch 364 and a top sliding latch 366. At its rear end the plug is connected to a table 366 and at its front end it is connected through an aperture in a panel 360 to a receptacle 372 which sticks to the panel by means of a bracket of the bracket 344.

Figure 39:
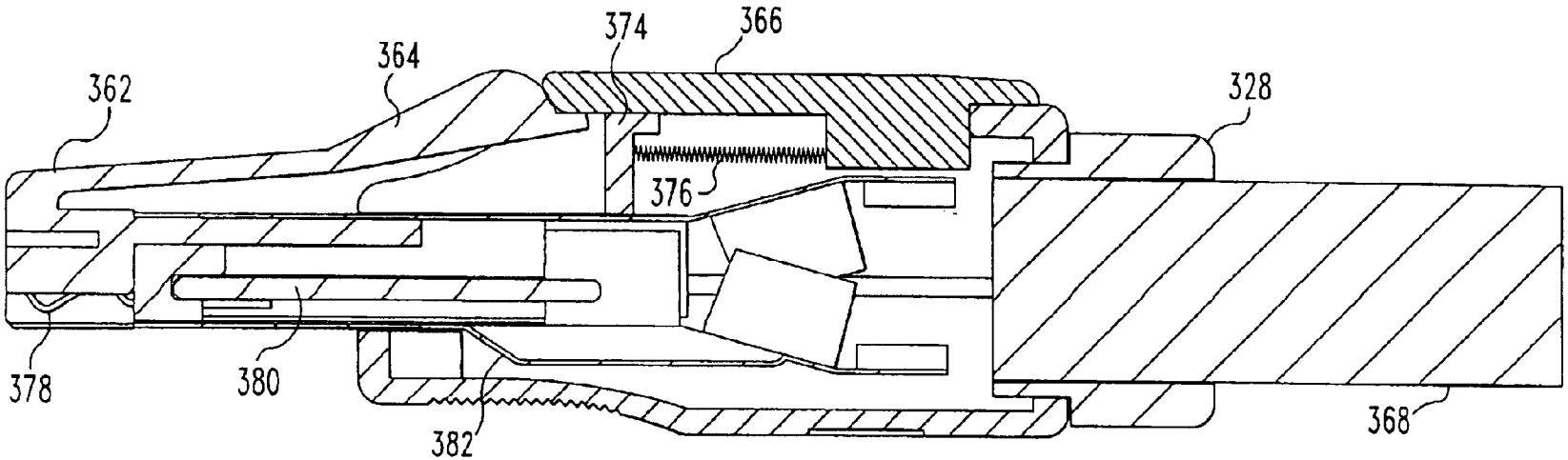
FIG. 39 is a longitudinal cross sectional view of the plug shown in FIG. 38.

Referring to FIG. 39, it will also be seen that the plug also includes a spring support 374 with a compression spring 376. There are also contacts 378, a printed circuit board 380 and an internal shield 382. It will be appreciated that this plug may be disengaged from the receptacle either by means of pressing downwardly on the front latch 364 or sliding the top sliding latch 366, in a forward direction against compression spring 367 to push the forward direction to depress the front latch 364.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising;

an insulative body;

an electrically conductive terminal received on the insulative body, an electrical shield member disposed in shielding relationship with respect to the terminal;

a first latching structure integral with the shield member for receiving a latch associated with a mating connector; and a second latching structure integral with the shield member for engaging a bracket, wherein the shield member forms a housing structure having an opening for receiving said mating connector, wherein the shield member is formed of sheet metal into the housing structure having a fore portion surrounding said opening, said fore portion having a longitudinally extending slot therein, and said second latching structure comprising at least: one projection extending forward from the fore portion and laterally to engage the bracket.

2. The electrical connector of claim 1 wherein the first latching structure is located adjacent said opening.

3. The electrical connector of claim 2 wherein the shield member is formed of a metal member; and wherein the first latching structure comprises a latch retention surface formed in the metal member.

4. The electrical connector of claim 3 wherein the shield member is formed of sheet metal and the latching structure includes a tang formed of said sheet metal bent inwardly into the opening.

5. The electrical connector of claim 3 wherein said first latching structure comprising a pair of inwardly bent tangs, said tangs being arranged in opposed relation on each side of said slot.

* * * * *